US007296448B1

(12) United States Patent
Shaw

(10) Patent No.: US 7,296,448 B1
(45) Date of Patent: Nov. 20, 2007

(54) ELECTROMAGNETIC INTEGRATIVE DOOR LOCKING DEVICE

(76) Inventor: Barry M. Shaw, 3306 N. Olcott, Chicago, IL (US) 60076

( * ) Notice: Subject to any disclaimer, the term of this patent is extended or adjusted under 35 U.S.C. 154(b) by 108 days.

(21) Appl. No.: 10/787,723

(22) Filed: Feb. 26, 2004

Related U.S. Application Data

(63) Continuation of application No. 09/790,455, filed on Feb. 22, 2001, now Pat. No. 6,745,603.

(51) Int. Cl.
*E05B 47/06* (2006.01)
*E05B 47/00* (2006.01)
*E05B 49/00* (2006.01)
*E05C 1/06* (2006.01)

(52) U.S. Cl. ..... 70/283; 70/279.1; 70/277; 70/278.7; 292/144

(58) Field of Classification Search ..... 70/283, 70/279.1, 277, 278.7; 292/144
See application file for complete search history.

(56) References Cited

U.S. PATENT DOCUMENTS 3,677,043 A * 7/1972 Cox ..... 70/92
4,099,752 A * 7/1978 Geringer ..... 292/144
4,677,834 A * 7/1987 Hicks ..... 70/279.1
4,691,542 A * 9/1987 Young ..... 70/129
4,784,415 A * 11/1988 Malaval ..... 292/144
4,949,563 A * 8/1990 Gerard et al. ..... 70/279.1
5,100,184 A * 3/1992 Schmitt ..... 292/144
5,474,348 A * 12/1995 Palmer et al. ..... 292/359
5,636,880 A * 6/1997 Miller et al. ..... 292/144

* cited by examiner

*Primary Examiner*—Katherine Mitchell
*Assistant Examiner*—David C Reese
(74) *Attorney, Agent, or Firm*—Adrienne B. Naumann

(57) ABSTRACT

Described herein is a locking device which integrates mechanical components in a hollow metal door frame with electronic access components. The preferred embodiment comprises a magnetic field generating device, an appropriately shaped metal solenoid housing and a cam retaining locking bar attached to a hollow stem. The electronic components override the original mechanical components of the lock to create a fail-safe situation in which the original mechanical lock may be disabled. In the preferred embodiment, my upgraded locking device can be re-installed within a hollow door frame, thereby minimizing service costs and doorframe modification costs.

17 Claims, 12 Drawing Sheets

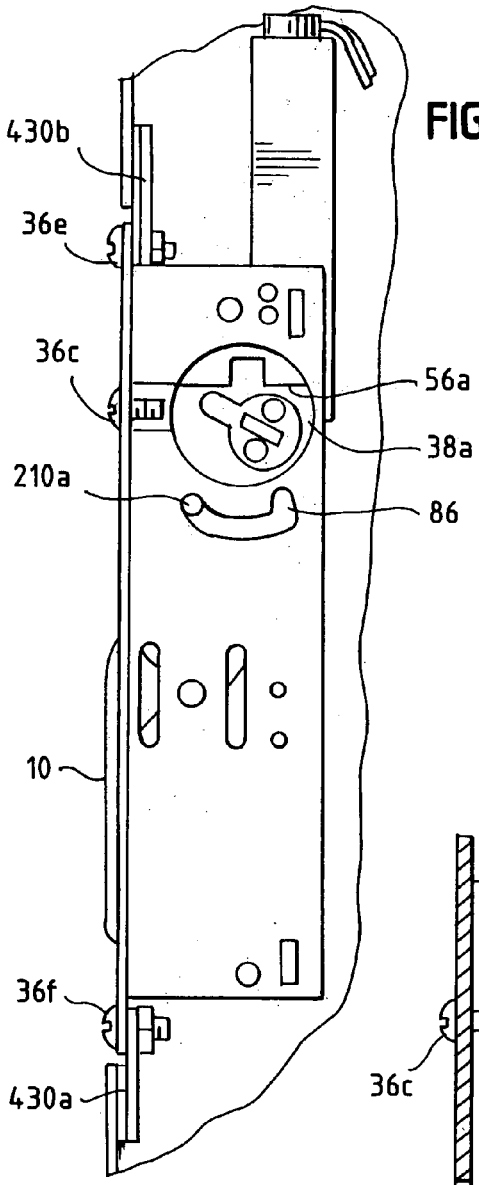
FIG. 2c
FIG. 3a
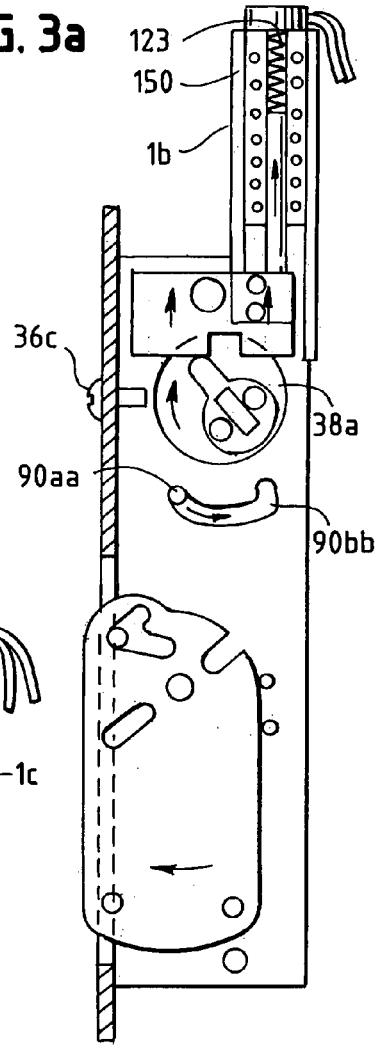
FIG. 3b
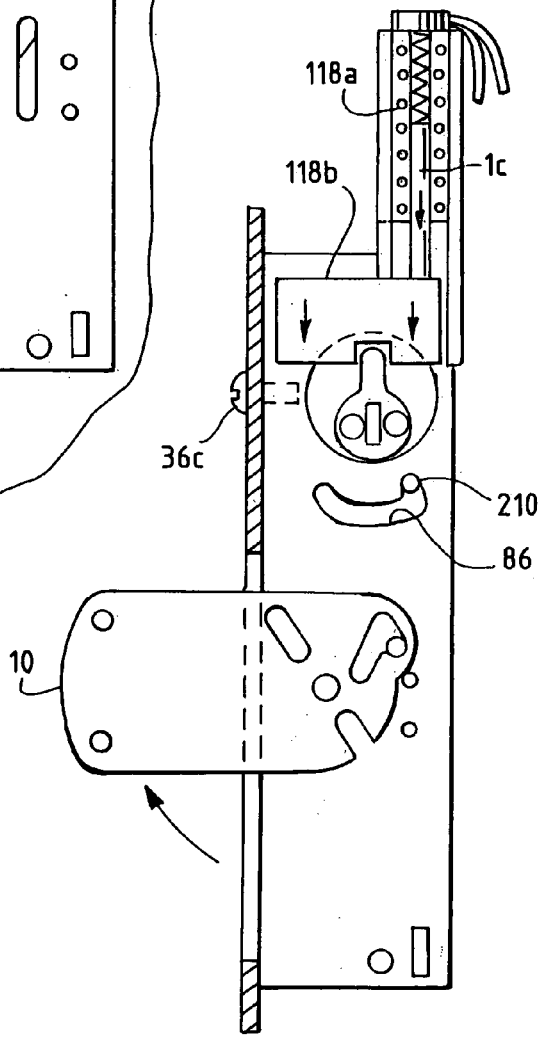

ELECTROMAGNETIC INTEGRATIVE DOOR LOCKING DEVICE

This application is a continuation of U.S. patent application Ser. No. 09/790,455 filed Feb. 22, 2001 now U.S. Pat. No. 6,745,603.

BACKGROUND OF THE INVENTION

My invention relates to the structure and operation of a previously installed mechanical door lock which is upgraded with override electromagnetic lock components. In particular my invention relates to electromagnetic locking components and deadbolt (or hook bolt), all of which are enclosed within a hollow doorframe casing. However, my new lock is also adaptable to other doors or other closed containers or spaces which require a fail-secure electronic locking component which overrides previously installed mechanical locking components.

In the preferred embodiment, my integrated lock is best suited to narrow stile doors, such as doors generally comprised of a glass core with a surrounding hollow metal frame. The lateral longitudinal plate comprises a longitudinal surface from which the bar or bolt extends through a rectangular opening. In addition to this lateral longitudinal plate, my invention comprises anterior and posterior plates. A longitudinal edge of each anterior or posterior plate is attached to a corresponding edge of the lateral longitudinal plate and forms a three-sided enclosure with two right angles.

In the preferred embodiment of my invention, the mechanical deadbolt operates from a fully extended position to a fully retracted position within the rectangular opening through an arc of 90 degrees. The operating mechanism comprises a rocking lever mounted perpendicular to the deadbolt. The rocking lever physically engages the deadbolt through pins and slot connections.

The cylindrical lock in my preferred embodiment is of the conventional type operable by a key. This lock cylinder carries a cylindrical extended shaft in which the key is inserted. The cylindrical extended shaft comprises a rotating cam member that attaches to the extended shaft's interior end with two screws. The operator rotates this cylindrical extended shaft clockwise or counterclockwise by turning the key within it.

The inner end of the deadbolt is bifurcated, and the legs formed therefrom contain arcuate shaped apertures. The legs are pivotally attached to the lower end of a rocking lever by a pivot pin which extends though the lower portion of the rocking lever. The rocking lever is physically positioned above the deadbolt and is adjacent to the lock cylinder.

Two opposing roller cams are mounted on a sleeve, and the sleeve ends move in a limited manner within curved apertures within each anterior or posterior plate. Each of these apertures in each plate is arcuate and at its ends each has upwardly extending grooves. In operating the rocking lever, there is engagement of each opposing roller cam within each anterior and posterior plate and within the lever, by which each roller cam moves within the limits of a keyhole shaped aperture within the rocking lever.

My invention does not change the function, purpose or intent of the prior art mechanical locking device: to secure the door against physical tampering. Instead, my new door lock provides a second level of security in addition to the conventional mechanical key method. With my new electromagnetic lock, a person (i) initially must have a card, fob or a correct code to enter onto a key pad, to (ii) subsequently release the keyed cylinder shaft for rotation.

A second level of security is important when business owners confront certain days and/or hours in which it is difficult, impossible or very expensive for a locksmith to make a service call and re-key the locks. In contrast, with my invention the business owner easily recodes an access control device without requiring a professional locksmith.

Installation of my invention alleviates this problem by addition of the following to the existing mechanical deadbolt or hook bolt:

1) solenoid or other magnetic field generating device;

2) a solenoid cylindrical casing which connects the solenoid to a prior mechanical installed lock component;

3) a hollow stem inserted in the cavity of the solenoid cylindrical casing with a locking portion attached thereto; and 4) a small spring between the hollow stem and hollow cavity within the solenoid cylindrical casing, The access control portion of the electronic portion of my invention includes:

1) an exterior door or frame mounted reader (i.e, proximity, magnetic swipe, biometrics hand, finger or eye reader, bar code reader, Dallas touch chip reader, digital push button keypad reader, etc.);

2) a door controller device which contains a circuit board, including but limited to memory e-prompt components, relay battery and wire connectors;

3) a transformer power supply and the appropriate wire connecting components.

When combined with stand alone or audit controlled computer based systems, such an access control system enables the business owner to create a report showing authorized employee access with the appropriate time and date. The door controller device identifies, via the reader, the previous entered information as to who can or cannot gain access. The door controller device can also electronically add or delete authorized users. The authorized person inserts his key, rotates the extendible shaft or pivot pin, and gains access only after the card access system has enabled the authorized person to gain access.

When the door control time has expired, usually about five or six seconds) the power rapidly ceases, thereby preventing the key from turning within the exterior cylinder lock. To comply with relevant fire codes, the interior keyed cylinder lock (or non-keyed thumb turn) on the interior surface of the doorframe cannot be controlled by the cam retaining locking bar. The absence of cam retaining locking bar control thereby allows persons unrestricted egress from a room or building interior in emergencies.

The process of installation of the electromagnetic component is another feature of my invention. My novel process of installation provides a significant economic advantage for, but not exclusively, commercial office space or privately owned businesses within large buildings. In these buildings, locks can be simultaneously upgraded with electronic security components without replacement or modification of a door component.

In addition, with my invention no new apertures are cut into the hollow metal doorframe casing to accommodate more expensive magnetic lock or electric strike hardware. Using my process, the operator removes the lateral, anterior and posterior plates and inserts a solenoid and associated components within the hollow metal doorframe casing.

The prior art discloses numerous mechanical locks cooperating with electrical components. However, these electrical components are not designed for installation after the mechanical locking component is installed within the doorframe. U.S. Pat. No. 5,561,997 (Milman) discloses a cylindrical barrel type lock wherein rotation of the barrel is prevented by one or more armatures. These armatures in turn are actuated by an electromagnet.

U.S. Pat. No. 5,542,274 (Thordmark et al.) discloses a cylinder lock comprising a key operated cylinder plug. A latching element is located near the boundary surface between the lock cylinder and a plug. There is also an electrical blocking element which moves between a release position and a blocking position. U.S. Pat. No. 3,733,861 (Lester) discloses an early electronic recognition door lock. Lester also comprises a solenoid which is activated to withdraw an abutment member from a laterally sliding door bolt mechanism. U.S. Pat. No. 5,469,727 (Spahn et al.) discloses an electronic lock cylinder comprising a housing with a cylindrical core.

Electronic control circuits are coupled inductively via coils for transmission of coding information. There is separate assembly of the mechanical components and of the electronic components of the lock cylinder. Spahn's electronic lock cylinder differs in part from my pending invention in that there is no disclosure of a process which integrates the electronic and mechanical components after prior installation of the mechanical component within a door frame.

U.S. Pat. No. 5,136,870 (Gartner et al.) discloses an electronic door lock. A digitally operated code input pad assembly enters a first code and a second code to open a second lock mechanism with the door spring bolt. These locks are adaptable for replacement of an ordinary deadbolt lock mechanism. However, Gartner's lock does not provide for subsequent installation within a doorframe of only the electronic lock component at a minimum cost and destruction of the doorframe.

Other early locks have even less technically in common with respect to upgrades with my present invention. U.S. Pat. No. 4,916,927 (O'Connell et al.) discloses a lock in which a solenoid can move an obstructing element entire into a recess. The presence or absence of the solenoid's magnetic field prevents turning of the shaft within a key cylinder. However, O'Connell's device must be installed with all its components simultaneously into a doorframe.

U.S. Pat. No. 4,831,851 (Larson) discloses a lock mechanism comprising a mechanical combination lock and an electronic lock. The mechanical combination lock serves as a fail-safe entry in case of failure of the electronic lock. However, this lock is specifically applicable to small safe deposit boxes.

U.S. Pat. No. 4,745,784 (Gartner) discloses an electronic dial combination lock. U.S. Pat. No. 3,748,878 (Balzano et al.), discloses an electrically controlled manual unit for a door lock. This lock also comprises a cylinder which contains a solenoid. The solenoid is energized to engage a clutch for rotation of the knob and connecting cam. Balzon's system, however, does not comprise an electronic component which can be installed subsequent to the mechanical lock unit within a door frame.

U.S. Pat. No. 5,636,880 (Miller)discloses an electronic lock which comprises a dead latch assembly for narrow stile locks, but not necessarily a hollow metal door frame casing comprising a door.

No distinct solenoid housing, cylindrical solenoid casing, or cam retaining locking bar is disclosed as described by Applicant, infra.

Furthermore, the operation of Miller's lock differs from that of Applicant's as it does not comprise a free standing electronically controlled obstructing component. In contrast, Applicant's electronically controlled element (cam retaining locking bar with attached stem and spring) rises within a magnetic field, and falls vertically in zero magnetic field.

My locking devise integrates previously installed mechanical locks with electronically controlled components which override entry-authorizing mechanical lock components. In particular, my new electromagnetic lock easily replaces a previously installed mechanical deadbolt with an improved electromechanically controlled deadbolt or hookbolt. My new lock is especially suited for small business properties with numerous narrow stile deadbolts, but who require a "second level" of electronic security. My lock installation also reduces costs and installation time from conventional locks with access control.

SUMMARY OF THE INVENTION

The scope of my invention includes physical and mechanical modifications of a variety of existing electronic and mechanical locking systems. However, my preferred embodiment is that of electronic upgrades to the deadbolt key activated device described herein.

The addition of a solenoid or equivalent electromagnetic device with a hollow stem and attached cam-retaining locking bar to any pre-existing mechanical lock is common to all embodiments of my invention, be it for doorframe casings or other egress entrance structures. In the preferred embodiment, the assembling operator attaches a solenoid/cam retaining locking bar above the mechanical locking components previously installed within a hollow metal doorframe casing.

Accordingly, one purpose of my invention is to integrate mechanical lock components previously installed within hollow glass/metal door frames with a variety of existing or future access controlled locking devices, particularly those of a proximity access code reader variety.

Another purpose of my invention is to lower the cost per door frame of upgrading existing mechanical locks with electronic security features, such as electric strikes and magnetic locks.

Another purpose of my invention is to provide small businesses with hollow glass/aluminum doors to economically obtain secure and affordable access control locking devices to these doors.

In addition, my new cam retaining locking bar greatly decrease a vandal's breakage of a locked door by wrenching the keyed cylinder with pliers or a wrench. These and other aspects of my invention will become apparent in the following detailed description of the preferred embodiment and other embodiments of my invention.

BRIEF DESCRIPTION OF THE DRAWINGS

FIG. 2*c* is an anterior lateral view of the assembled lock components.

FIG. 3*a* is a lateral view of mechanical and electronic locking components in an open unlocked position, and with the posterior plate removed.

FIG. 3*b* is a lateral view of mechanical and electronic locking components in a locked position and with the posterior plate removed.

DETAILED DESCRIPTION OF THE PREFERRED EMBODIMENT

Introduction

Figure 1:
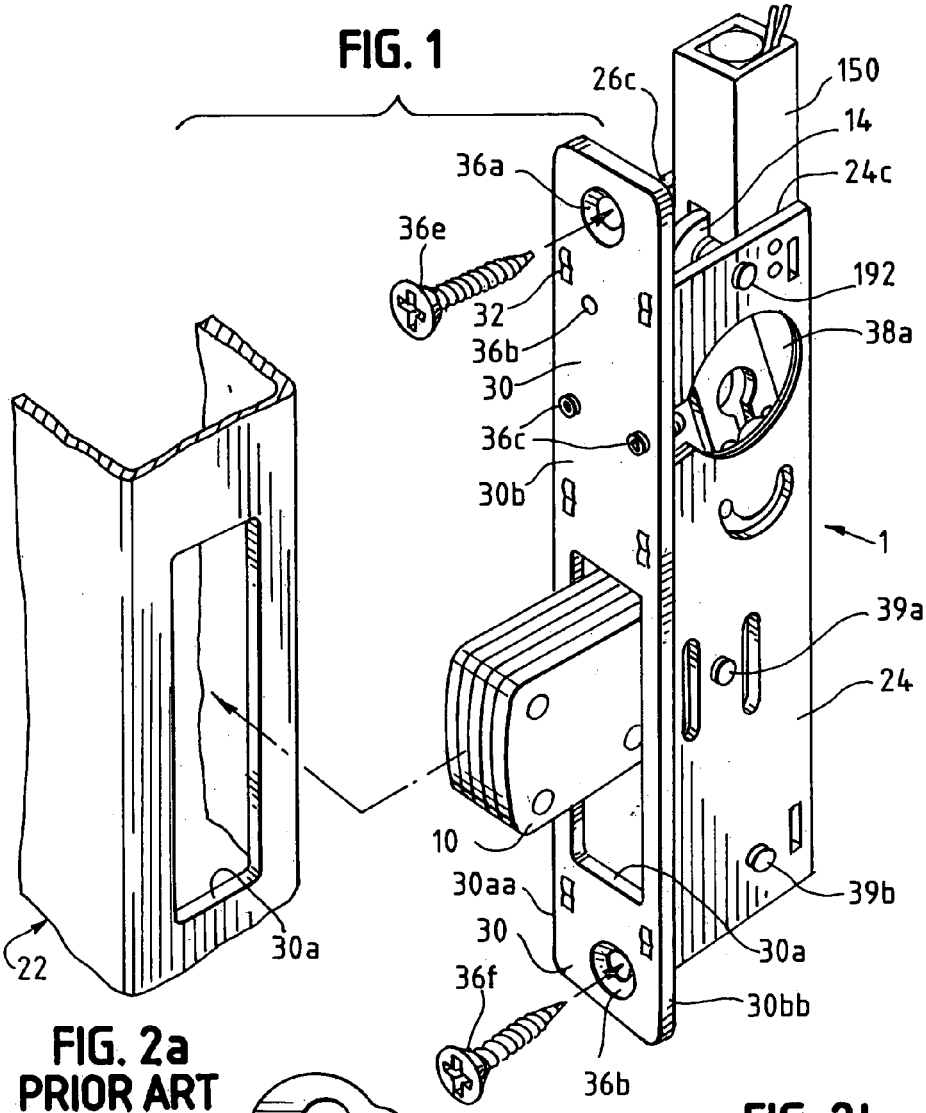
FIG. 1 illustrates a cutaway perspective view of the hollow metal doorframe casing and a partial anterior exterior view of my door lock components.

My electromagnetic integrated lock 1 comprises electromagnetic lock components with integrated prior art dead bolts 10 or hook bolts 10*a*. Each deadbolt 10 or hook bolt 10*a* was previously installed within a predetermined metal hollow doorframe casing 22 which comprises a door. The great advantage of my integrated lock is enhanced security without undue destruction of the existing hollow metal doorframe casing 22 and previously installed mechanical lock components.

My integrative lock components fit within any hollow metal doorframe casing 22, but most preferably within a narrow stile glass core/aluminum doorframe casing. Other door frames with similar material, mechanical and other physical properties are also within the scope of my invention. Also included within my invention are integrated lock components for other securing and secured structures, such as safe deposit boxes or safes. These other secured structures must comprise the necessary space and wiring to place and connect the lock.

My invention also comprises the method for installing an electromagnetic field generating device into a glass core/aluminum doorframe casing 22 containing a previously installed mechanical deadbolt 10 or hook bolt 10*a*. Using this method, the operator attaches a solenoid 1*a* and cam retaining locking bar 118*b* with hollow stem 118*a* above a pre-existing rocking lever 14 and deadbolt 10 within doorframe casing 22.

My novel installation method and integrated lock system includes an access code proximity reader 302 and associated processor 313 in the preferred embodiment. Such prior art electronic components and their operative installation are well known to those in the electronic security/locksmithing industry. Existing non-electronic mechanical lock components which are compatible with my invention include, but not exclusively:

(a) non-electronic glass core/aluminum door type dead bolts 10 and hook bolts 10*a*, including but not exclusively those of Adams Rite® Manufacturing Co.

4040S. Capitol Ave.

P.O. Box 1301

City of Industry, Ca. 91749

Phone: 562-699-0511

Models: MS 1850 series,
MS 1851, MS 1853 and (b)Trans Atlantic Co.

440 Fairmont Ave.Philadelphia, Pa. 19124

Phone: 215-629-0400;

888-523-9956

Model(Deadbolts): # DB 3231×31/32" BS, DB 3236×1 and 1/8" BS

Model (Hookbolts):# HL3241×31/32 BS. HL3236×1 and 1/8" BS and (c) Ultra Hardware Products, LLC.

1777 Hylton Road

Pennsauken, N.J. 08110

Phone: 800-426-6379

Fax: 888-858-7210

Model #: 4465, 44646,44650,44648 (Deadbolts) 44655,45660,44656,44658 (Hookbolts) and (d)International Door Closer 1920 Air Lane Drive Nashville, Tn 37210

Phone: 1-615-885-706;1-800-225-6737

Model #: DT 1853, 31/32"

DH 1823-5

DH 1823-H, 1 and 1/8"

DT 1851

DT 1852

DT 1854 All with 1 and 1/2" back set,

DT 1855 with and without weather strip

DT 1853 and

Prime-Line

P.O.Box 9910

San Bernadino, Cal. 92427

Phone: 800-255-3505

J-4524,J-4567

J-4525,J-4568

J-4526, J-4567

J-4537, J-4568

Installation of my electromagnetic integrative components is economical, when using access control security technologies such as proximity reads, bar code reads and Dallas Touch Chip®. These technologies also include the ubiquitous swipe cards presently on the market, as well as any future developed electronic access features. Readers, push button keypad technologies or electronic timers are also satisfactory. However, the most preferred electronic access technology for my invention is a proximity access code reader 302, which is a device well known in the industry.

The above list of mechanical and electronic access lock assemblies is non-exclusive. Other prior art mechanical lock components, or those developed in the future, are also within the scope of my invention. The central features of the preferred embodiment of my invention include:

(i) an on/off magnetic field source, most preferably a solenoid 1*a* connected to a proximity access code reader 302, and (ii) a cam retaining locking bar 118*b* and attached hollow stem 118*a* functionally connected to (iii) a mechanical locking component such as a deadbolt 10 or hook bolt 10*a*.

American National Standards Institute and Builders Hardware Manufacturer's Association (ANSI/BHMA) specifications are met by my invention as well.

Previously Installed Non-Electronic Mechanical Lock

A hollow metal doorframe casing 22 may be left handed or right handed. If a hollow metal doorframe casing 22 is installed in a right-handed orientation, the hinges will be on the right side of the doorframe casing 22 and the lock is on the left hand side(when the operated is facing the exterior hollow metal doorframe 22 surface). Similarly, a hollow metal doorframe casing with a left handed orientation has hinges on the left side of the doorframe casing 22; the lock is on the right side edge of the doorframe casing 22, when the operator is facing the exterior surface of that doorframe casing 22.

The preferred door for my invention are narrow stile doors, such doors generally being comprised of a glass core with a surrounding hollow metal doorframe casing 22. The preferred metal is aluminum for hollow metal doorframe casing 22. Also in the preferred embodiment is a hollow metal doorframe casing 22 with hardware preparation according to ANSI standards.

Figure 13A:
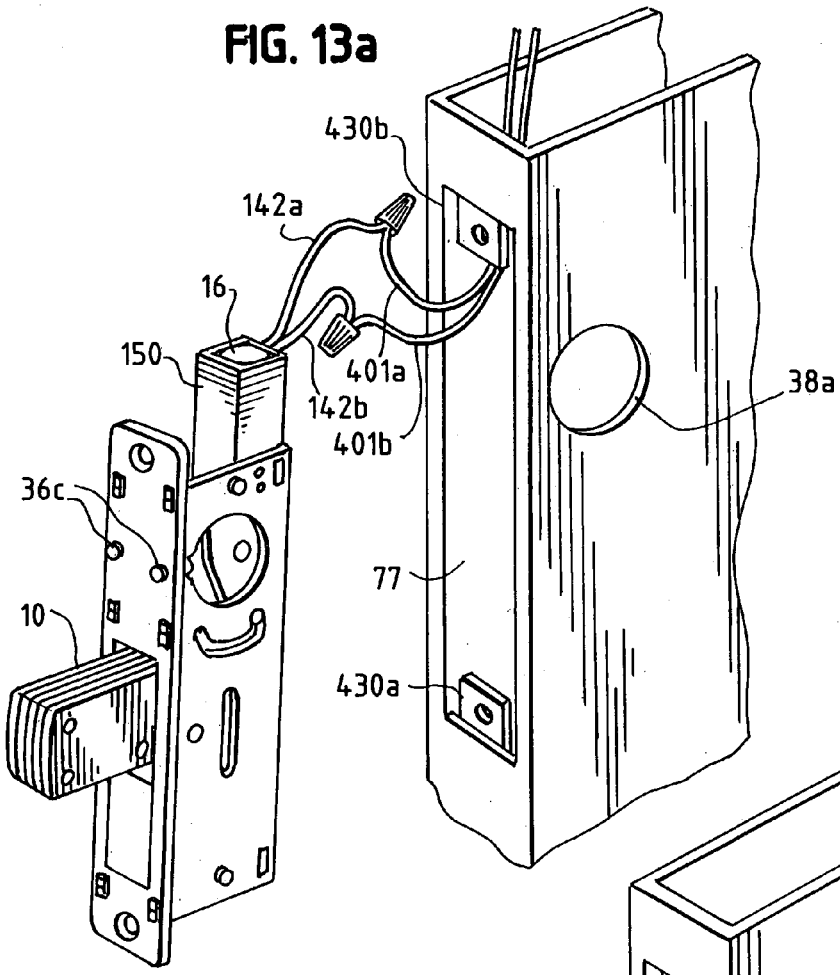
FIGS. 13*a* and 13*b* illustrate how the plate assembly containing the integrated lock components is reinserted into the hollow metal doorframe casing.
Figure 13B:
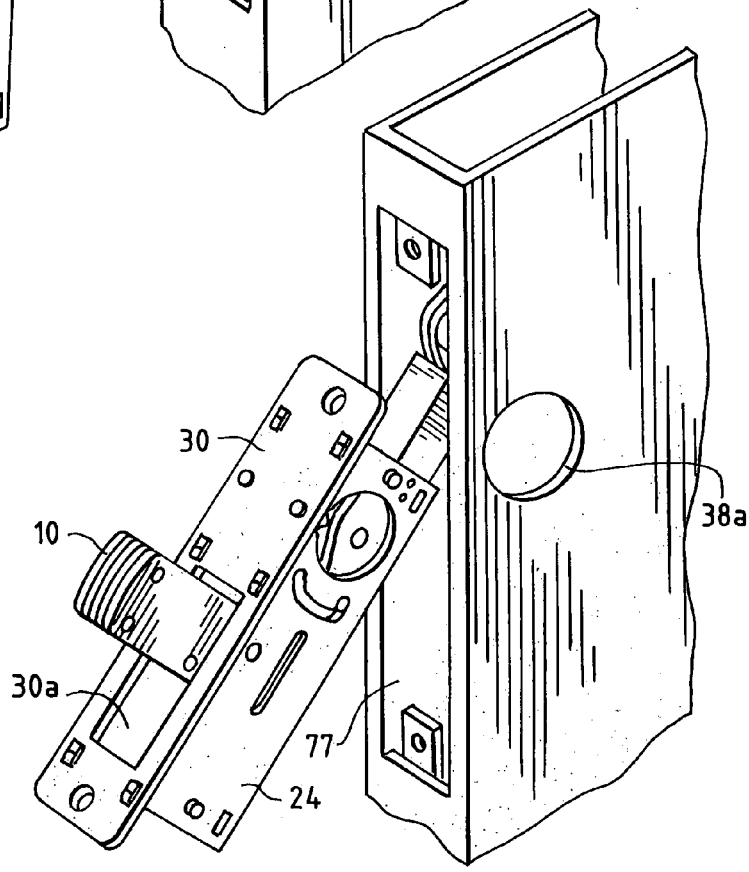

As seen in FIGS. 13*a* and 13*b*, the preferred hollow metal doorframe casing 22 comprise welded-in lock mounting tabs 420. Mounting tabs 420 require no post installation modifications to fit an actual lock with a mounting pattern conforming to ANSI standards. In a doorframe casing 22 without these integrally welded tabs, separately purchased individual tabs are attached to hollow metal doorframe casing 22.

The hollow metal doorframe casing 22 manufacturer for my preferred embodiment is:

International Aluminum

767 Monterey Park

Monterey Park, Cal. 91757

Website: www.intlalum.com

Door Model No. Series: 250,400,550

FIG. 1 is a cutaway perspective view of hollow metal doorframe casing 22. Within hollow metal doorframe casing 22 are anterior plate 24 and posterior plate 26 (not seen), and lateral longitudinal plate 30. Lateral longitudinal plate 30 has two longitudinal edge 30*aa*,30*bb*, each of which is attached to either anterior plate 24 or posterior plate 26 at an approximate 90 degree angle. In the preferred embodiment, a trim plate or face plate covers set screws 30*c* and gives lateral longitudinal plate a more pleasing appearance.

Referring again to FIG. 1, anterior plate 24 comprises aperture access for mechanical lock components as well as the electronic components of my integrated invention 1. Posterior plate 26 (not seen) contains thumb turn 43 in my fully assembled invention. Thumb turn 43 is positioned on the office interior door surface, and it allows egress according to relevant fire and safety ordinances. Please see FIGS. 6*b*, 6*c*.

As seen in FIGS. 1 and 2*c*, set screws 36*c* support cylinder lock 66 and thumb turn 43 within large circular apertures 38*a*, 38*b* (not seen in this view) respectively. Shorter mounting screw 36*a* and longer lower mounting screw 36*b* attach lateral longitudinal plate 30 to hollow metal doorframe casing 22.

Referring again to FIG. 1, longitudinal rectangular opening 30*a* lies congruently within lateral longitudinal plate 30 and hollow metal doorframe casing 22. Each plate 24, 26 is attached to lateral longitudinal plate 30 with pressure fitted (pinned) metal stubs 32 in a manner well known in the industry. Solid pins 39*a*,39*b* connect plates 24,26 to each other, while pin 39*a* also acts as a sleeve for rotation of deadbolt 10 or hook bolt 10*a*. Lateral longitudinal plate 30 has a longitudinal vertically oriented exterior surface 30*b*. Dead bolt 10 respectively extends through longitudinal rectangular opening 30*a* when deadbolt 10 is in an extended position.

Figure 2A:
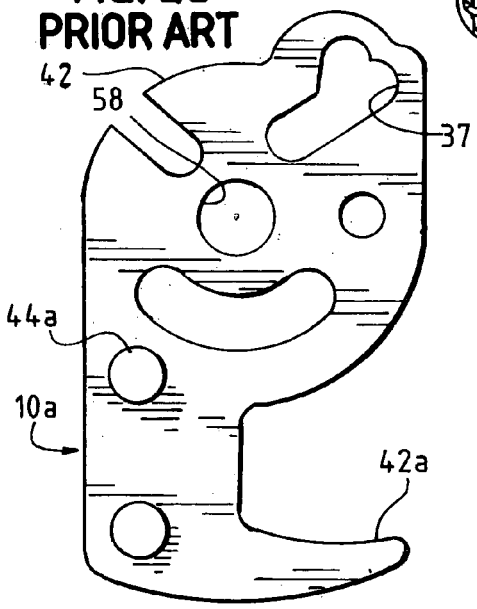
FIG. 2a PRIOR ART
FIG. 2*a* is a lateral view of typical prior art deadbolt.

The deadbolt 10 of my invention comprises a modified version of the mechanical locking assembly disclosed in U.S. Pat. No. 2,853,839 (C. W. Eads). FIG. 2*a* illustrates the preferred prior art deadbolt 10 comprising first and second legs 42, 44 respectively. Hook bolt 10*a* is another prototype which is similar to my preferred deadbolt 10 embodiment. The only difference between hook bolt 10*a* and deadbolt 10 is the curved configuration of hook bolt 10*a* which engages the opposing wall and/or strike plate.

Again referring to FIG. 2*a*, deadbolt 10 or hook bolt 10*a* each comprise upper arcuate slot 37 and round bolt aperture 58. Upper arcuate slot 37 houses lever pivot pin 50. Round bolt aperture 58 contains bolt support pin 39*a* and sleeve 39*b* (not seen in this view). In the preferred embodiment rivet 44*a* holds five steel plates together, thus forming either deadbolt 10 or hookbolt 10*a*.

Referring now to FIGS. 1 and 3*a*, anterior plate 24 comprises exterior threaded large circular aperture 38*a*. FIG. 6*d* illustrates posterior plate 26 which comprises interior large threaded circular aperture 38*b* (through which threaded thumb turn inserts. Interior and exterior threaded circular large apertures 38*a*,38*b* respectively are each approximately one and three-quarters (1 and ¾ inch) in diameter.

Figure 2B:
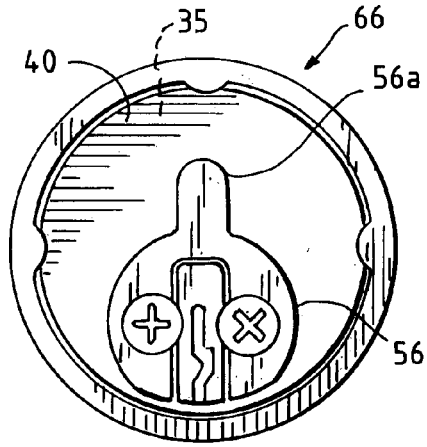
FIG. 2b PRIOR ART
FIG. 2*b* is a posterior view of a typical prior art cylinder lock with an attached rotating cam.

Exterior large circular aperture 38*a* is the structure into which threaded cylinder lock 66 inserts within anterior plate 24. FIG. 2*b* is an isolated posterior view of cylinder lock 66. Posterior plate 26 comprises interior large circular aperture 38*b* into which thumb turn 43 inserts in a manner similar to that of lock cylinder 38, infra.

Referring to FIG. 6*d*, within cylinder lock 66 lies extendible shaft 35, and attached to its posterior end 40 is rotating cam member 56. Rotating cam member 56 is attached to lock cylinder 66 with two small screws 66*a*, 66*b*.

Posterior end 40 of extendible shaft 35 is 'journaled' into exterior large circular aperture 38*a*, and is supported therein by set screws 36*c*. Rotating cam member 56 rotates upon extendible shaft 35 with application of manual force to turn authorized key Please see FIG. 6. Extendible shaft 35 does not turn until a properly fitted key 152 inserts within cylinder lock 66. As seen in FIG. 2*b*, rotating cam 56 comprises an integral protruding member 56*a*.

Figure 6:
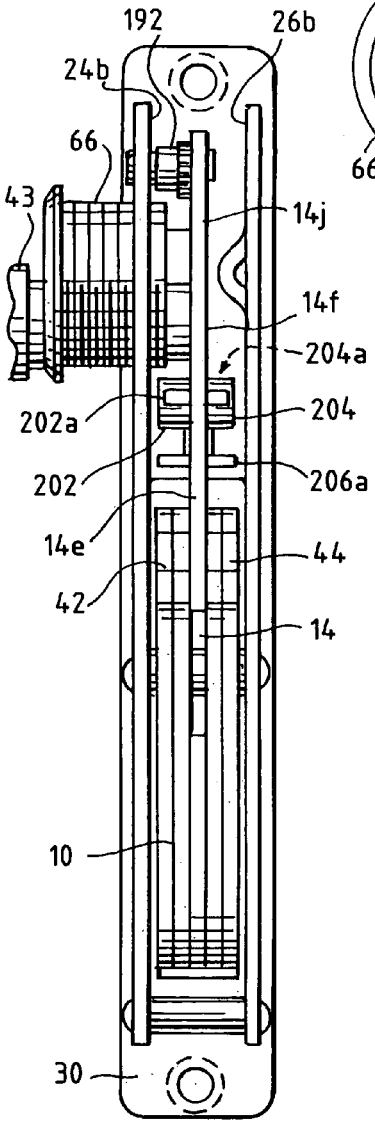
FIG. 6 PRIOR ART
FIG. 6 illustrates prior art mechanical lock components with lateral longitudinal plate removed.
Figure 6A:
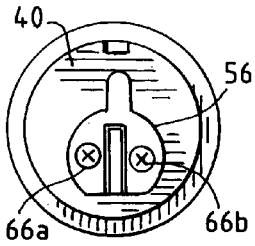
FIG. 6*a* illustrates an isolated close up view of a rocking lever and attached rotating cam with integral protruding member.
Figure 6B:
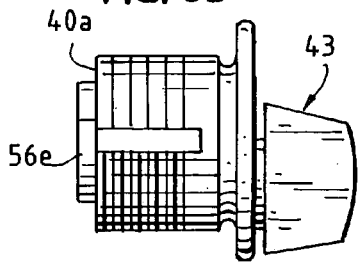
FIG. 6*b* illustrates an isolated close up lateral view of a prior art thumb turn component.
Figure 6C:
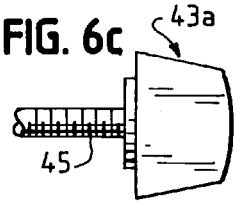
FIG. 6*c* is an isolated prior thumb turn and attached thumb turn plug in my invention.
Figure 6D:
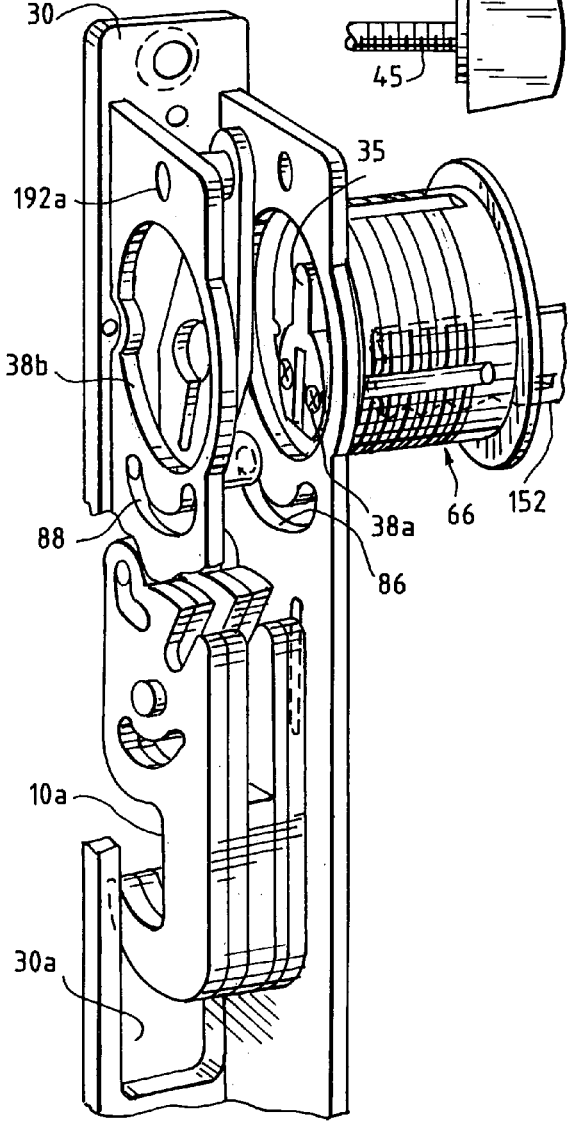
FIG. 6*d* illustrates the partially assembled mechanical prior art components.
Figure 6F:
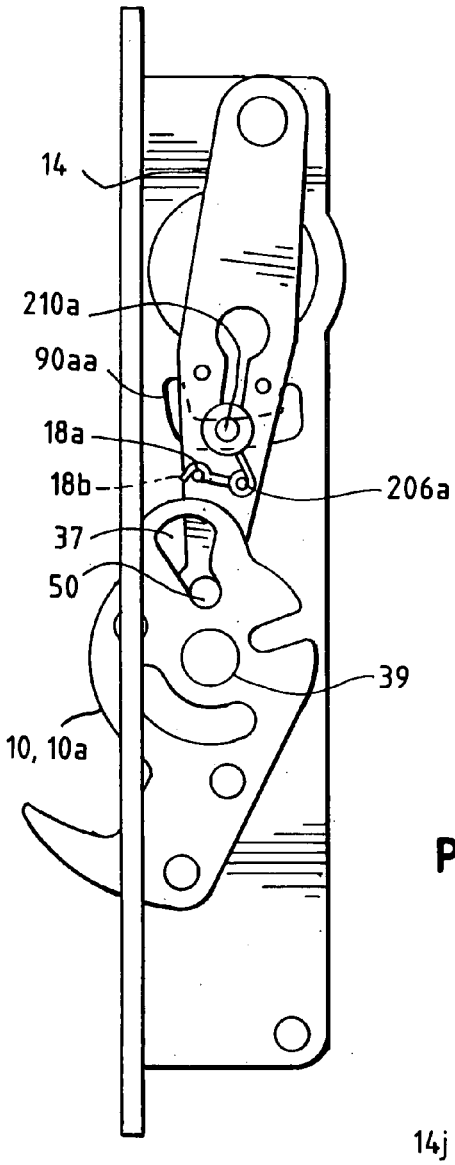
FIG. 6f PRIOR ART
FIG. 6*f* is a lateral isolated view of the interaction of prior art mechanical components in a locked position, and with the posterior plate removed.
Figure 6G:
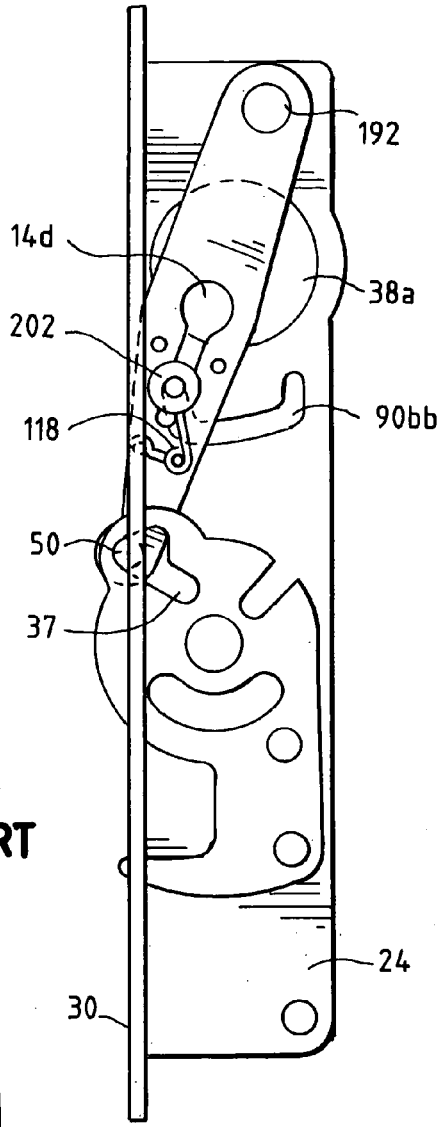
FIG. 6g PRIOR ART
FIG. 6*g* is a lateral isolated view of the interaction of prior art mechanical components in an unlocked retracted position, and with the posterior plate removed.

As seen in FIGS. 6, 6*f* and 6*g*, thumb turn 43 is structurally similar to cylinder lock 66 in that it comprises a plug 45 attached to a permanently fixed second rotating cam 56*e* at posterior end 40*a*. However, no key is necessary to rotate second rotating cam 56*e* and initiate retraction of deadbolt 10, so that egress to an office exterior is universal: integral thumbturn handle 45*a* and attached plug 45 always turns rotating cam 56*e* when manual rotational force is applied.

Attached second rotating cam 56*e* also holds thumb turn plug firmly within thumb turn 43. Small screws 66*aa*, 66*bb* (not seen) attach second rotating cam 56*a* to plug 45.

Referring now to FIGS. 6, 6*f* and 6*g*, rocking lever 14 is positioned between first and second legs 42,44 respectively by lever pivot pin 50 within upper arcuate slot 37. Lever pivot pin extends through lever 14 and completely penetrates deadbolt 10.

Figure 6H:
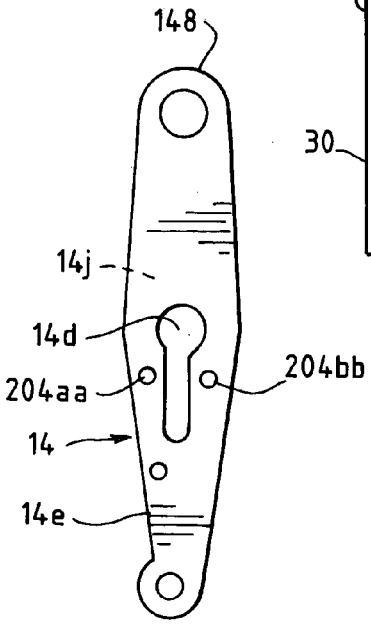
FIG. 6h PRIOR ART
FIG. 6*h* is an isolated lateral longitudinal view of a prior art rocking lever.

As seen in FIG. 6*h*, rocking lever 14 comprises bulbular slot 14*d*, into which a first opposing roller cam 202 and a second opposing roller cam 204 lodge (not seen in this view). Referring to FIG. 6, first opposing roller cam 202 abuts first longitudinal lever surface 14*e* while second opposing roller cam 204 abuts second longitudinal lever surface 14*f*.

In addition, each first and second opposing roller cam 202, 204 respectively also abuts first extending pin 202*a* and second extending pin 204*a* (not seen in FIG. 6) respectively. Third extending pin 206*a* is located below first and second roller opposing cams 202,204; third extending pin 206*a* pierces lever 14 through each first and second longitudinal surface 14*e*, 14*f*. Third extending pin 206*a* also comprises first spring 18*a* and second spring 18*b*. Please see FIG. 6*g*.

First and second springs 18*a*, 18*b* respectively each engage approximately one-half of the circumference of extending pin 206*a* and opposing roller cams 202, 204 respectively. First opposing roller cam 202 and second opposing roller cam 204 rotate around sleeve 210 and are mounted thereon. Sleeve ends 210*a*, 210*b* of sleeve 210 extend to and enter first and second curved apertures 86,88 respectively within anterior and posterior plates 24,26 respectively.

First small spring 18*a* and second small spring 18*b* wind around the circumferences of opposing roller cams 202, 204 and extension pin 206 respectively, on either longitudinal surface 14*e*, 14*f*. First small spring 18*a* and second small spring 18*b* each generate an upward force: this occurs when small springs 18*a*,18*b* extend after rotating cam 56*a* presses down upon first opposing roller cam 202 or second opposing roller cam 204. This upward force tends to maintain first opposing roller cam 202 and second opposing cam 204 in the same position, unless manual force from a turning key 152 is applied in the opposite direction.

Referring again to FIG. 6, rocking lever 14 is mounted vertically between anterior plate 24 and posterior plate 26, and rocking lever 14 also physically abuts rotating cam 56. Referring again to FIG. 6*g*, in the preferred embodiment rocking lever 14 engages deadbolt 10 with lever pivot pin 50 within upper arcuate slot 37.

Upper arcuate slot 37 within deadbolt 10 accommodates the relative movement between physically contacting rocking lever 14 and deadbolt 10. Small adjacent apertures 202*aa* and 202*bb* accommodate extension pins 202*a* and 204*a* respectively, as seen in FIG. 6*h*.

Rocking lever 14 also comprises bulbular slot 14*d*, through which opposing roller cam members 202,204 move when authorized key 152 is inserted into extended shaft 35. Large sleeve 192 penetrates first longitudinal surface 14*e* and second longitudinal surface 14*f*, as seen in FIG. 6.

Figure 8:
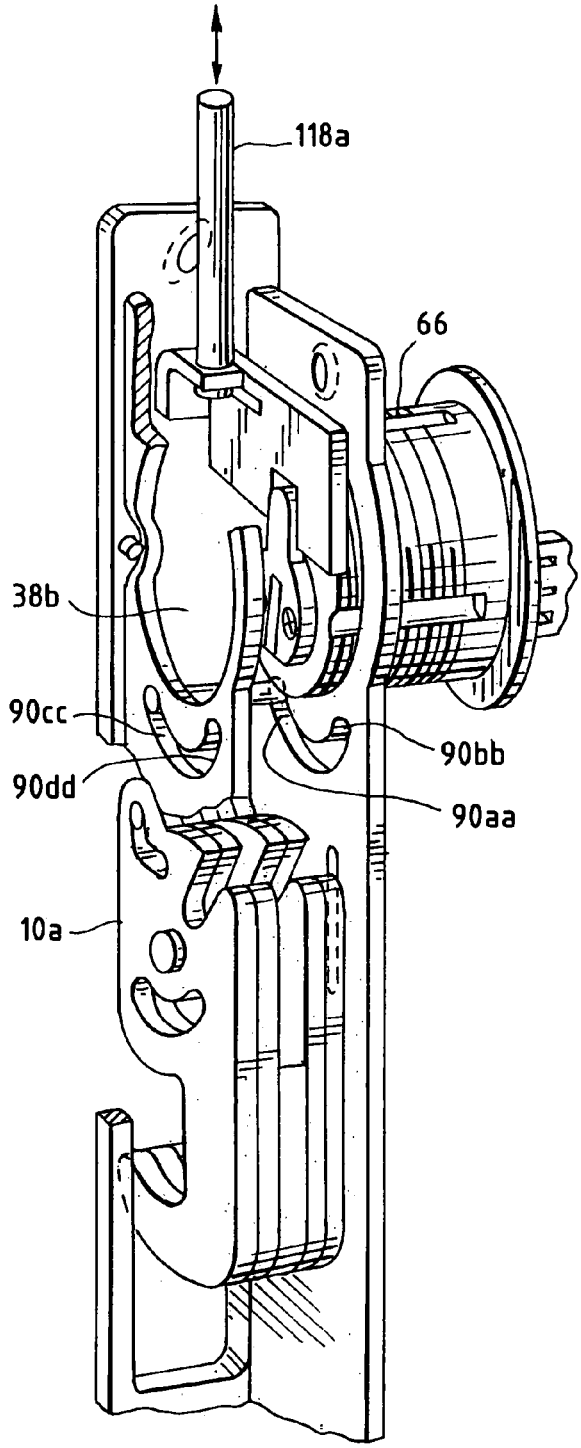
FIG. 8 illustrates a partial perspective view of the integrated locking components, and with posterior plate removed and lateral longitudinal plate partially cut away.

FIGS. 2*c*, 3*a* and 3*b* illustrates sleeve end 210*a* within first curved aperture 86 of anterior plate 24. Sleeve end 210*b* is similarly situated within second curved aperture 88 of posterior plate 26(not seen in these views). Sleeve ends 210*a*, 210*b* each move within first curved aperture 86 and second curved aperture 88 respectively. First curved aperture 86, comprises first upwardly extending short grooves 90*aa*, 90*bb*, while second curved aperture comprises second upward extending short grooves 90*cc*, 9*odd*. Please see FIG. 8.

The mechanical components of my invention operate as follows:

Extending shaft 35 rotates as force is applied through an authorized key 152. Rotating movement of rotating cam 56*a* causes protruding member 56*a* to rotate downward. While rotating downward, protruding member 56*a* directly pushes upon first opposing roller cam 202 or second opposing roller cam 204(depending upon whether these predetermined lock components are mounted in a left handed or right handed orientation). This direct force results in rotating cam 56 pushing against opposing roller cams 202 or 204, and thereby stretching small springs 18*a*, 18*b*. This direct force upon first opposing roller cam 202 and second opposing roller cam 204 also simultaneously pushes both opposing roller cams 202, 204 downward through bulbular slot 14*d*.

First and second opposing roller cams 202,204 respectively move downward through bulbular slot 14*d* as long as rotating cam's force exceeds that of stretched first and second small springs 18*a*,18*b*. Sleeve ends 210*a*, 210*b* move through curved apertures 86,88 respectively.

Stretched small spring 18*a*, 18*b* now push sleeve ends 210*a*, 210*b* respectively upwardly into upwardly extending short grooves 90*aa*,90*bb*, and 990*cc*, 90*dd* respectively. At the same time, lever pivot pin 50 travels downward within upper arcuate slot 37, causing deadbolt 10 to rotate around bolt pivot pin 39 and retract deadbolt 10 to an open unlocked position.

When rotating cam 56 is rotated, sleeve ends 210*a*, 210*b* move through curved apertures 86 or 88 respectively. This movement occurs when sleeve ends 210*a*, 210*b* are pushed upwardly by first small spring 18*a* and a second small spring 18*b*. Movement to a retracted position by deadbolt 10 and lever 14 ceases when sleeve ends 210*a*, 210*b* respectively finally lodge within upwardly extending short grooves 90*bb*, and 90*dd* respectively. Please see FIG. 6*g*.

Conversely, during a transition from a retracted position to the usual locked sleeve ends 210*a*, 210*b* move in the opposite direction within first and second curved apertures 86,88 respectively. When returning to a locked position, each sleeve end 210*a*, 210*b* moves through curved apertures 86,88 respectively until lodged within upwardly extending first and second grooves 90*aa*, 90*cc* respectively. The position of rocking lever 14 and deadbolt is mechanically held in place within grooves 90*cc* and grooves 90*bb*.

As seen in FIG. 6*g*, deadbolt 10 is in a retracted unlocked position. To lock, key 152 now twists in the opposite direction or until rotating cam 56 is restored to its original vertical position. At the same time the tension of first and second small springs 18*a*, 18*b* forces rocking lever 14 and deadbolt 10 to a default lock position again.

When key 152 rotates and is then removed from cylinder lock 66, rotating cam 56 rotates to its original vertical position. At this point, rotating cam 56 no longer exerts force on first and second opposing roller cams 202 or 204.

Integrative Electronic Components of my Invention

FIG. 1 illustrates an exterior view of my electromagnetic integrated locking components within lateral longitudinal plate 30, anterior plate 24 and posterior plate 26. In the preferred embodiment crucial physical measurements are as follows:

(i) the distance between interior surfaces of 24*b*, 26*b* of anterior plate and posterior plate 26 respectively is slightly more than approximately ⅝ inch;

(ii) the distance between interior anterior plate surface 24*b* and longitudinal lever surface 14*e* is approximately ⅜ inch.

Figure 4A:
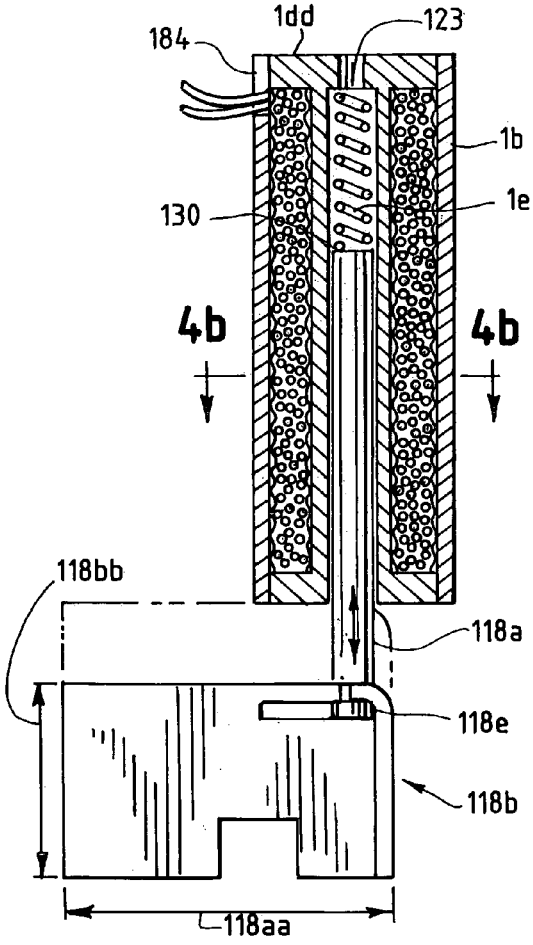
FIG. 4*a* is an isolated view of a solenoid within a cylindrical solenoid casing and attached to a cam retaining locking bar.
Figure 4B:
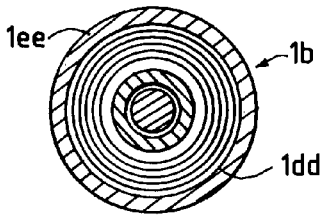
FIG. 4*b* is a top plan view of a cylindrical solenoid casing.
Figure 4C:
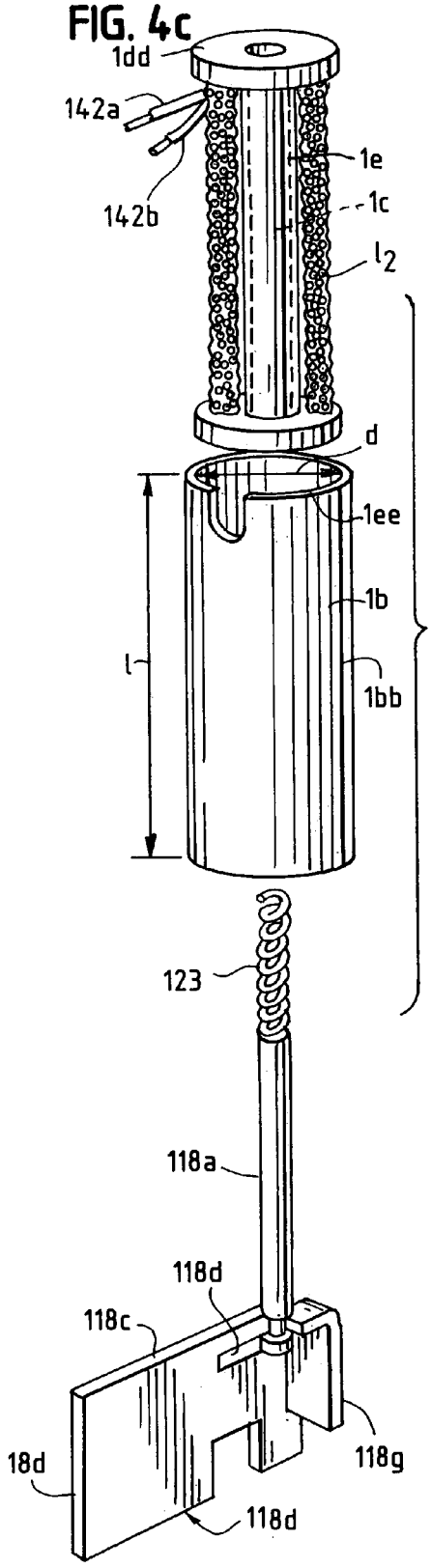
FIG. 4*c* is a disassembled view of a solenoid, solenoid cylindrical casing, solenoid housing and cam retaining locking bar with attached hollow stem.

(iii) the length 1 and diameter d of solenoid casing 1*b* are approximately 1 and ¾ inch, and ½ inch respectively;

(iv) the length of posterior plate 26 or anterior plate is approximately six inches;

(v) the length of lateral longitudinal plate 30 is approximately seven inches;

(vi) the length of hollow stem 118*a* is approximately 1 and ¼ inch;

(vii) the width and length of cam retaining locking bar 118*b* are approximately 1 and ¼ inch and ¾ inch respectively;

(viii) the diameter of hollow stem 118*a* is approximately ⅜ inch;

(ix) the length of protruding member 56*a* is approximately ¼ inch;

(x) metal solenoid housing 150 is approximately 2 and ¾ inch in height, slightly less than ⅝ inch in width and depth, and its walls are approximately ⅛ inch in thickness;

In the preferred embodiment, the devise which generates a magnetic field is solenoid 1*a*. However, other electromagnetic field generating devices are also within the scope of my invention As seen in FIGS. 4*a* and 4*c*, in the preferred embodiment solenoid 1*a* comprises a cylindrically wound wire 130 forming a solenoid cylindrical cavity 1*c*. Solenoid cylindrical cavity 1*c* is approximately 1 and ¾ inches in length 1 and approximately ½ inch in diameter d. Solenoid cavity 1*c* preferably lies within a hollow cylindrical spool 1*e*, as best seen in FIG. 4*c*.

Cylindrically wound wire 130 is approximately 81 feet in length, and is wound contiguously to form the entire length of solenoid 1*a*. The cross-sectional diameter of cylindrically wound wire 130 is approximately 0.015 inch in the preferred embodiment. Solenoid 1*a* is preferably comprised of copper wire in all its embodiments. As seen in FIGS. 4*a* and 4*c*, there are no fluid dynamics present in my preferred embodiment, nor are there fluid dynamics in other embodiments of my invention. There are also no additional energy or voltage producing devices which generate a magnetic field specifically for elevating a lock component within any embodiments of my invention.

Cylindrical solenoid casing 1*b* is a cylindrical metal structure with a circular top metal surface 1*dd* as well as a lower circular metal surface. Top metal surface 1*dd* also comprises the upper end of hollow cylindrical spool 1*e* upon which solenoid 1*a* is wound in the preferred embodiment. Top metal surface 1*dd* is attached at all points to upper circular edge lee of cylindrical solenoid casing 1*b*. Cylindrical solenoid casing 1*b* completely covers solenoid 1*a* on all surfaces, except for continuous solenoid pinhole 184.

Figure 5:
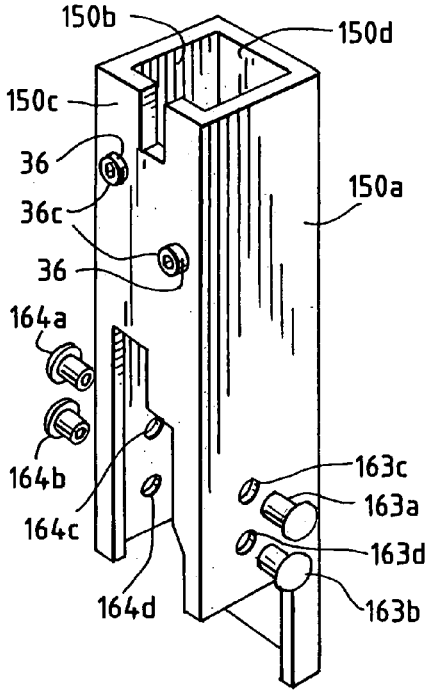
FIG. 5 comprises an isolated partial perspective view of a solenoid housing with screw apertures.
Figure 5E:
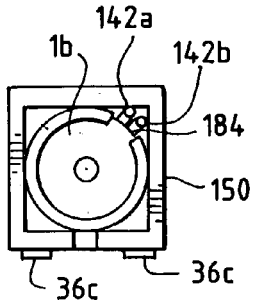
FIG. 5*e* is an upper plan view of a solenoid housing containing cylindrical casing 1*b*.

Referring now to FIGS. 4*a* and 5*e*, cylindrical solenoid casing 1*b* comprises continuous pinhole aperture 184. Continuous pinhole aperture 184 is formed in part between cylindrical solenoid casing side 1*bb* and circular top metal surface 1*dd*. First solenoid end wire 142*a* and second solenoid end wire 142*b*, which are integral with solenoid cylindrically wound wire 130, emerge from continuous pinhole aperture 184. First solenoid end wire 142*a* comprises the beginning segment of solenoid wire 130. Second solenoid end wire segment 142*b* electrically connects to a voltage source (not seen) and closes the circuit in a manner well known in this industry, infra.

Referring to FIG. 4*c*, in the preferred embodiment solenoid 1*a* comes pre-assembled upon hollow cylindrical spool 1*e*. Hollow solenoid cavity 1*c* is now within hollow cylindrical spool 1*e*, while hollow cylindrical spool 1*e* is enclosed within cylindrical solenoid casing 1*b*. A pre-assembled solenoid 1*a* within a cylindrical casing 1*b*, and wound upon hollow cylindrical spool 1*e* for the preferred embodiment is available from:

TRW Space and Electronic Group

5200 Springfield Street

Beaver Creek, Ohio

Model Number 29.0250-16 VAC

Phone: 937-253-1609, and is distributed through Adams Rite,® Inc. In all embodiments, stainless steel is the preferred material for cylindrical solenoid casing 1*b*.

Referring now to FIGS. 1 and 5, cylindrical solenoid casing 1*b* contains solenoid 1*a*, and lies within a metal solenoid housing 150. Metal solenoid housing 150 protects cylindrical solenoid casing 1*b* containing solenoid 1*a*, as well as the cylindrical cavity 1*c* into which hollow stem 118*a* inserts in a magnetic field. Please see infra. Metal solenoid housing 150 fits between first and second interior opposing surfaces 24*b*, 26*b* respectively of anterior plate 24 and posterior plate 26 respectively.

Metal solenoid housing 150 comprises a hollow polygon in cross-section, preferably a rectangle, and consists of two first opposing parallel sides 150*a*, 150*b* and two second opposing parallel sides 150*c*,150*d* (generically 150). Metal solenoid housing 150 attaches to: anterior plate 24 by first and second small rivets 163*a*, 163*b* respectively, through first and second apertures 163*c*, 163*d* respectively; and to posterior plate 26 by third and fourth small rivets 164*a*, 164*b* respectively, through third and fourth apertures 163*c*, 164*d* respectively. Please see FIG. 5.

Figure 5A:
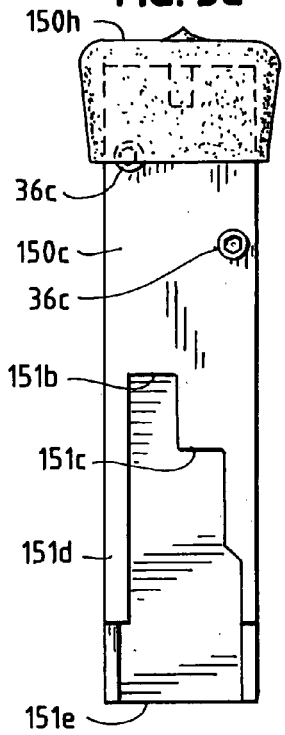
FIG. 5*a* is an isolated anterior view of a solenoid housing in a left handed orientation.
Figure 5B:
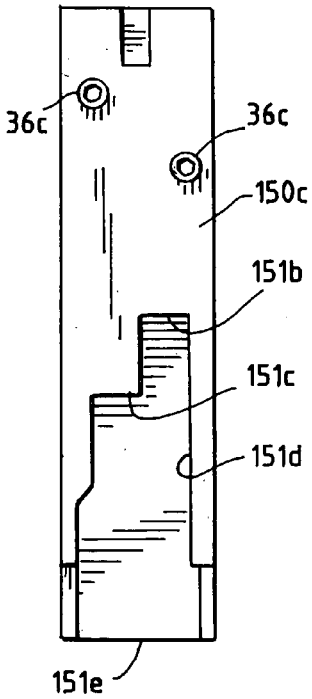
FIG. 5*b* is an isolated anterior view of a solenoid housing in a right-handed orientation.
Figure 5C:
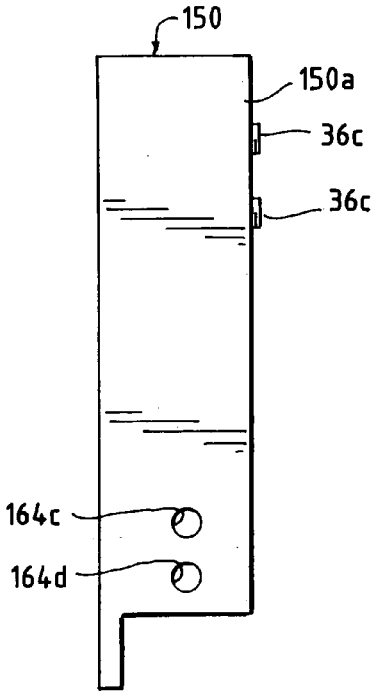
FIG. 5*c* is a lateral isolated view of a solenoid housing in a left-handed orientation.
Figure 5D:
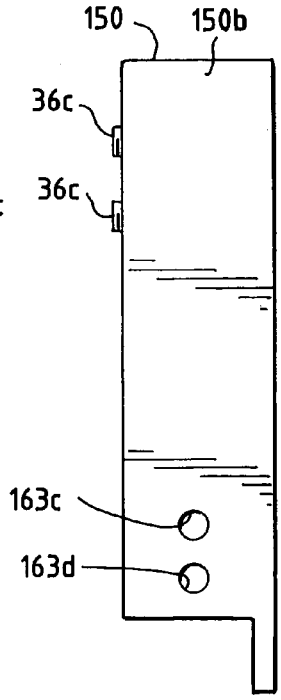
FIG. 5*d* is an isolated lateral view of a solenoid housing in a right-handed orientation.

There is no floor or ceiling to metal solenoid housing 150, thereby leaving one open upper end 150*g* and one open lower end 150*i*. As seen in FIG. 5*a*, removable plastic cap 150*h* fits tightly but reversibly over upper open end 150*g* of solenoid housing 150. Removable plastic cap 150*h* prevents moisture from entering solenoid housing 150 and damaging solenoid 1*a*. Removable plastic cap 150*hh* extends approximately 0.5 inch along each side of solenoid housing 150.

Figure 16:
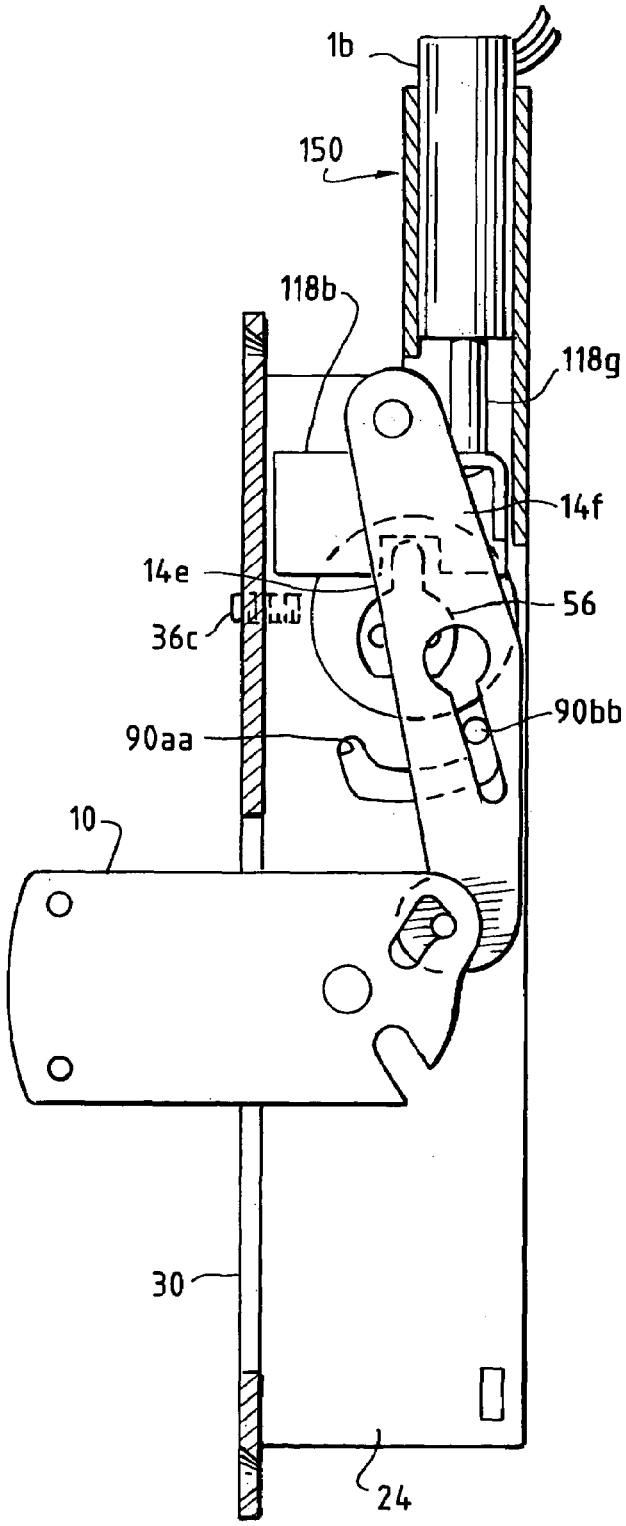
FIG. 16 is the lateral interior view of the lock assembly with the anterior plate removed, and in an entirely locked position.

Opposing parallel side 150*c* of metal solenoid housing 150 lies parallel to longitudinal lateral plate 30, and side 150*c* is shorter than opposing parallel side 150*d*. The preferred metal solenoid housing 150 is made from aluminum to avoid rust problems from drainage. As seen in FIG. 16 metal solenoid housing 150 does not interfere with round threaded circular apertures 38*a*, 38*b*. Approximately ⅔ of metal solenoid housing 150 protrudes above first upper edge 24*c* of anterior plate 24 and second upper edge 26*c* of posterior plate 2. Please see FIG. 1.

Solenoid metal housing 150 can be made of tubing from:

J. G. Braun Co.

81145 River Drive

Morton Grove, Ill. 60053

Phone: 1-800-323-4072

As seen in FIG. 5, in the preferred embodiment upper open end 150*g* of solenoid housing 150 contains a slot 150*m* for egress of enclosed solenoid end wires 142*a*, 142*b*, infra. Solenoid housing 150 also comprises housing apertures 36 for insertion of set screws 36*c* through two opposing parallel sides 150*c*, 150*d*. Set screws 36*c* stabilize cylindrical solenoid casing 1*b* in the proper position within solenoid housing 150.

As further seen in FIG. 5*a*, each opposing side comprises from one to two set screws 36*c* towards each upper open end 150*g*. There are a total of from two to four set screws 36*c* within solenoid housing 150. Each pair of set screws 36*c* on each opposing side 150*c*, 150*d* are in staggered horizontal alignment to each other.

To prepare a metal solenoid housing 150 in the preferred embodiment, the operator uses a Dremel® wheel to section aluminum square tubing. This aluminum square tubing is approximately ⅝ inch in diameter and two feet in length, and is made of metal alloy number 6063-T52. Metal solenoid housing 150 can be easily massed produced by an appropriate tool shop in this manner. In addition, aluminum does not retain heat from solenoid electrical resistance, and this feature result's in less damage to surrounding electronic components.

Metal solenoid housing 150 appears in isolated close up lateral view in FIG. 5*a*. Solenoid housing lower edge 151 is shaped so protruding member 56*a* can rotate freely, and cam retaining locking bar 118*a* can easily disengage from rotating cam 56, infra. FIG. 5*a* illustrates first lower edge segment 151*d* of lower solenoid housing edge 151. With first lower edge segment 151*d* as a backstop, key 152 cannot force cam retaining locking bar 118*b* laterally, see infra. Also because of this physical backstop, movement of cam retaining locking bar 118*b* remains vertical.

FIG. 5*a* also illustrates second lower edge segment 151*b* of lower solenoid housing edge 151. Edge segment 151*b* is pre-cut to accommodate upper edge 14*g* of rocking lever 14, as well as large sleeve 192 and large pin 192*a*. This precut feature becomes especially important when metal solenoid housing 150 is pushed downward to its final position during the installation process.

In all embodiments of my invention, each solenoid housing 150, cylindrical solenoid casing 150 and solenoid 1*a*, are distinct and separate physical entities from each other. This is always true, even though physically distinct and integral solenoid 1*a* lies within cylindrical casing 1*b* and physically distinct and integral cylindrical solenoid casing 1*b* is contained within integral solenoid housing 150.

Referring now to FIGS. 4*a* and 4*c*, third spring 123 lodges within hollow stem 118*a*, when hollow stem 118*a* is attached to cam retaining locking bar 118*b*. Solenoid cavity 1*c* within cylindrical solenoid casing 1*b* comprises a sufficient diameter for hollow stem 118*a* to move vertically upward within solenoid cavity 1*c*. For the preferred embodiment, hollow stem 118*a* is available as a component from the catalogue model of:

TRW Space and Electronic Group

5200 Springfield Street

Beaver Creek, Ohio

Model Number 29.0250-16 VAC

Phone: 937-253-1609, and is distributed through Adams Rite®, Inc.

Hollow stem 118*a* is fabricated from stainless steel in this preferred assembly. For other embodiments, hollow stem 118*a* is made from stainless steel pins. As best seen in FIGS. 4*a* and 4*c*, hollow stem 118*a* does not function or comprise a piston, because pistons are solid cylinders or disks which move back and forth in a larger cylinder under fluid pressure.

In the preferred embodiment, attached to hollow stem 118*a* is cam retaining locking bar 118*b*. Cam retaining locking bar 118*b* comprises a length 118*aa*, a width 118*bb*, and a thickness 118*c*. Cam retaining locking bar 118*b* also comprises a small army 118*g* and a small ovoid slot 118*d* which grips hollow stem 118*a*. Notch 118*c* grips protruding member 56*a* in a default locked position, as described infra. Hollow stem comprises knob 118*e* which fits within arm 118*g* and ovoid slot 118*d*.

The measurements of cam retaining locking bar 118*b* in the preferred embodiment are approximately as follows: ⅝ inch in width, 1 and ¼ inch in length, and 1/16 inch in thickness. As seen in FIG. 5, cam retaining locking bar 118*b* abuts rocking lever 14 and is parallel to longitudinal surfaces 14*e*,14*f* of rocking lever 14.

Hollow stem 118*a* is approximately 3/16 inch in diameter and approximately 1 and ⅜ inches in length. As seen in FIGS. 4*a* and 4*c*, hollow stem 118*a* comprises knob 118*e*. Knob 118*a* fits at approximately a right angle to and within small ovoid slot 118*d* in the preferred embodiment. However, other attachment devices of hollow stem 118*a* and cam retaining locking bar 118*b* are also within the scope of my invention.

Tension from third spring 123 against cylindrical solenoid casing 1*b* tends to return hollow stem 118*a* and cam retaining locking bar 118*b* to a lower position. Compression of third spring 123 against cylindrical casing surface 1*dd* also prevents inadvertent permanent magnetization of hollow stem 118*a*. Third small spring 123 pushes downward upon hollow stem 118*a* and forces hollow stem 118*a* from top metal surface 1*dd* of cylindrical solenoid casing 1*b*.

However, hollow stem 118*a*'s downward vertical movement is simultaneously limited by the rectangular notch of cam retaining locking bar 118*b* around protruding member 56*a*. Please see FIG. Third small spring 123 does not serve as a centering device, but rather to disengage hollow stem 118*a* from cylindrical solenoid casing 1*b*.

When attached to cam retaining locking bar 118*b*, hollow stem 118*a* rises within solenoid cylindrical casing 1*b* through hollow solenoid cavity 1*c* whenever a magnetic force field exists within hollow solenoid cavity 1*c*. A subsequent magnetic force field of solenoid 1*a* can initiate another access cycle by raising hollow stem 118*a* into hollow solenoid cavity 1*c* until the voltage is again discontinued.

Cam retaining locking bar 118*b* comprises an alloy mix to soften the steel component, so that cam retaining locking bar 118*b* is die cast to the correct shape. In the preferred embodiment, cam retaining locking bar 118*b* is best obtained from:

Precision Hardware, Inc.

P.O. Box 74040

Romulus, Mo. 48174-0040

Phone: 734-326-7500

This cam retaining locking bar 118*b* is preferably the clip from model #1639-10 of the electric strike 1639-10 series. In other embodiments, cam retaining locking bar 118*b* is best made from a thin steel sheet of appropriate thickness with chrome plating. In all embodiments, the alloy comprising cam retaining locking bar 118*b* is at least approximately 10% zinc and 50% steel. This particular alloy is also popularly known as pressed steel, or cold rolled steel, in the locksmithing industry.

Figure 7:
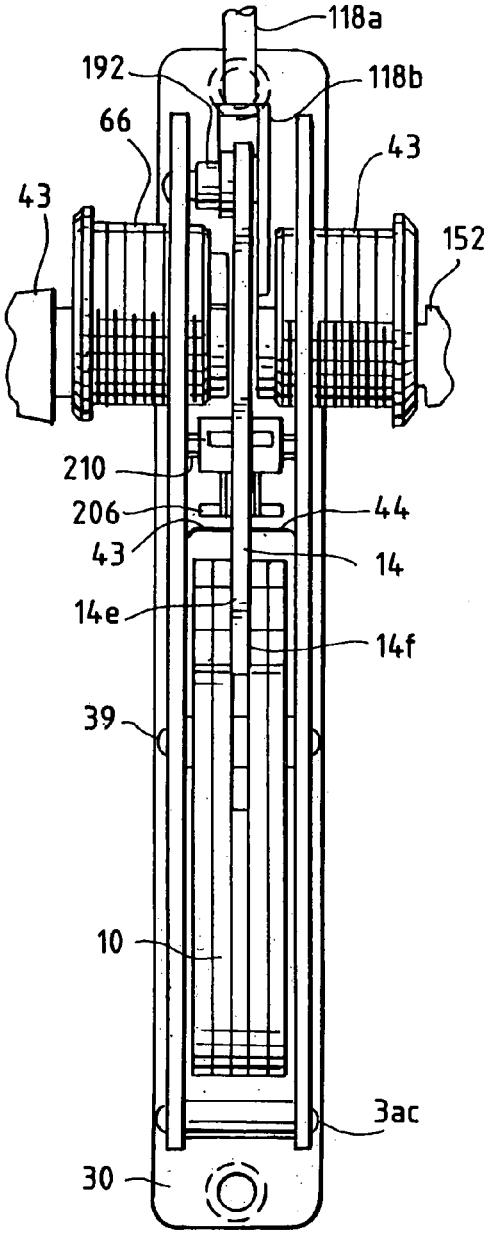
FIG. 7 illustrates a lateral posterior view of locking components, including a key and a thumb turn.

FIG. 7 illustrates my integrated lock components when posterior plate 26, metal solenoid housing 150 and cylindrical solenoid casing 1*b* are removed. Rocking lever 14 is adjacent to cam retaining locking bar 118*b*. FIG. 16 illustrates hollow stem 118*a* containing third spring 123 in default locked position. Hollow stem 118*a* containing third spring 123 lies partially within solenoid housing 150 and solenoid casing 1*b*.

Cylindrical solenoid casing 1*b* stands within metal solenoid housing 150. Referring again to FIGS. 3*a* and 3*b*, my integrated invention operates as follows in the preferred embodiment and best mode:

When solenoid 1*a* generates a magnetic field, its force lines are concentrated primarily through hollow solenoid cavity 1*c*. When this field presents within hollow solenoid cavity 1*c*, then cam retaining locking bar 118*b* moves vertically upward until attached hollow stem 118*a* is further within hollow solenoid cavity 1*c*. When power is added to solenoid 1*a* to generate a magnetic field, hollow stem 118*a* with attached cam retaining locking bar 118*b* elevates approximately ⅜ inch.

As seen in FIGS. 2*c* and 3*b*, cam retaining locking bar 118*b* now disengages rotating cam 56. In this upper position, cam retaining locking bar 118*b* no longer restricts rotating cam 56 from rotating downward. As a result, rotating cam member 56 is now unhindered and rotates away from its blocking position of extendible shaft 35. Force from rotating key 152 causes protruding member 56*a* to abut and exert force upon first opposing roller came 202 and second opposing roller cam 204 respectively.

When force is exerted by rotating cam 56 upon opposing roller cams 202,204, lever pivot pin 50 slides downward within slot 37. At the same time, sleeve ends 210*a*, 210*b* move within curved apertures 86,88, and deadbolt pin 58 within slot 38 retracts deadbolt 10 to an open unlocked position, as described supra.

As illustrated in FIG. 3*a*, when voltage to solenoid 1*a* is discontinued, there is no magnetic field to elevate cam retaining locking bar 118*b* (and attached hollow stem 118*a*) vertically upward. Cam retaining locking bar 118*b* falls vertically downward to grasp protruding member 56*a*. Protruding member 56*a* physically blocks authorized key 152 from turning rotating shaft 35. First and second opposing roller cams 202, or 204(depending upon whether this is a right handed or left handed assembly) now cannot initiate the mechanical events which result in retraction of deadbolt 10.

Tension of third spring 123 also contributes force, to return to the lower gripping position of cam retaining locking bar 118*b* and attached hollow stem 118*a* when there is no magnetic field. Again referring to FIG. 3(*b*), the electronic and mechanical components are in the default locked position when there is no magnetic field. Cam retaining locking bar 118*b* grips protruding member 56*a* rigidly so that rotating cam 56 prevents force upon opposing roller cams 202, 204.

As a result, there is no force upon first and second opposing roller cams 202, 204 to initiate deadbolt 10 retraction. Consequently, electronically controlled cam retaining locking bar 118*b* overrides key 152 access, when there is no magnetic field to elevate cam retaining locking bar 118*b* to a non-gripping position.

In the preferred embodiment, my invention uses proximity access codes for identification of authorized access and subsequent generation of voltage across solenoid 1*a*. The process, known as radio frequency identification (RFID), is a method of reading an electronic key card 301 without physical contact between card 301 and reading device 302. The user holds electronic key card 301 to a reading device 302, and within the reading device's detection range, similarly to that of a television remote control device.

Figure 9:
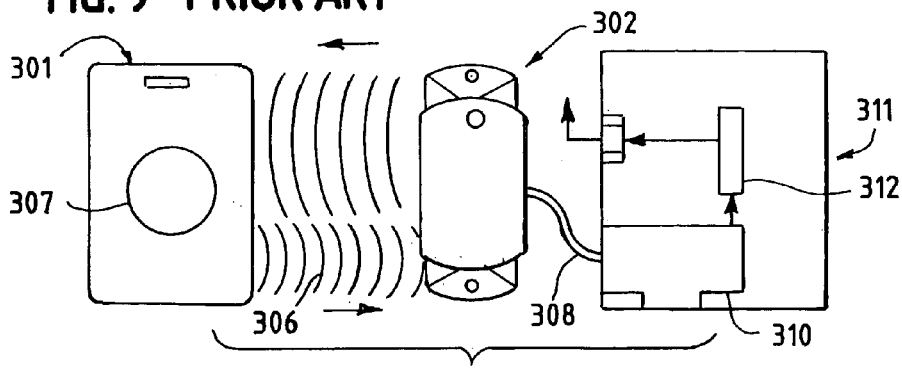
FIG. 9 PRIOR ART
FIG. 9 is a schematic representation of a proximity access code reader and processor.

Referring now to FIG. 9, immediately thereafter a continuous 125 kHz (kilohertz) electromagnetic field 304 radiates from a metal coil within reading device 302. When reading device 302 detects electronic key card 301, card coil 307 within card 301 detects excitation signal 306 from reading device 302. Excitation signal 306 in turn generates a small current in card coil 307. This current powers a small integrated circuit within electronic key card 301, when card 301 contains a unique identification number.

Card coil 307 within electronic key card 301 transmits this identification (ID) number using a 62.khz electromagnetic field (which is one-half the value of excitation signal 306). This 62.5 kHz electromagnetic field is an analogue RF carrier for the digital I.D. number, and is the receive signal in reading device In this context, an analogue RF carrier is actually an antenna within key card 301.

Reading device 302 transmits the receive signal to RF receiver 310 within door controller 311. Door controller 311 processes, error checks and converts receive signal to a digital signal. RF receiver 310 sends the digital signal with the identification number to microprocessor 312 within door controller In the preferred embodiment, door controller 311 is a SM Intelliprox model SM 1000/2000 smart module. This model is well known in the electronic industry, and can be obtained from Keri Systems Incorporated.

Figure 10:
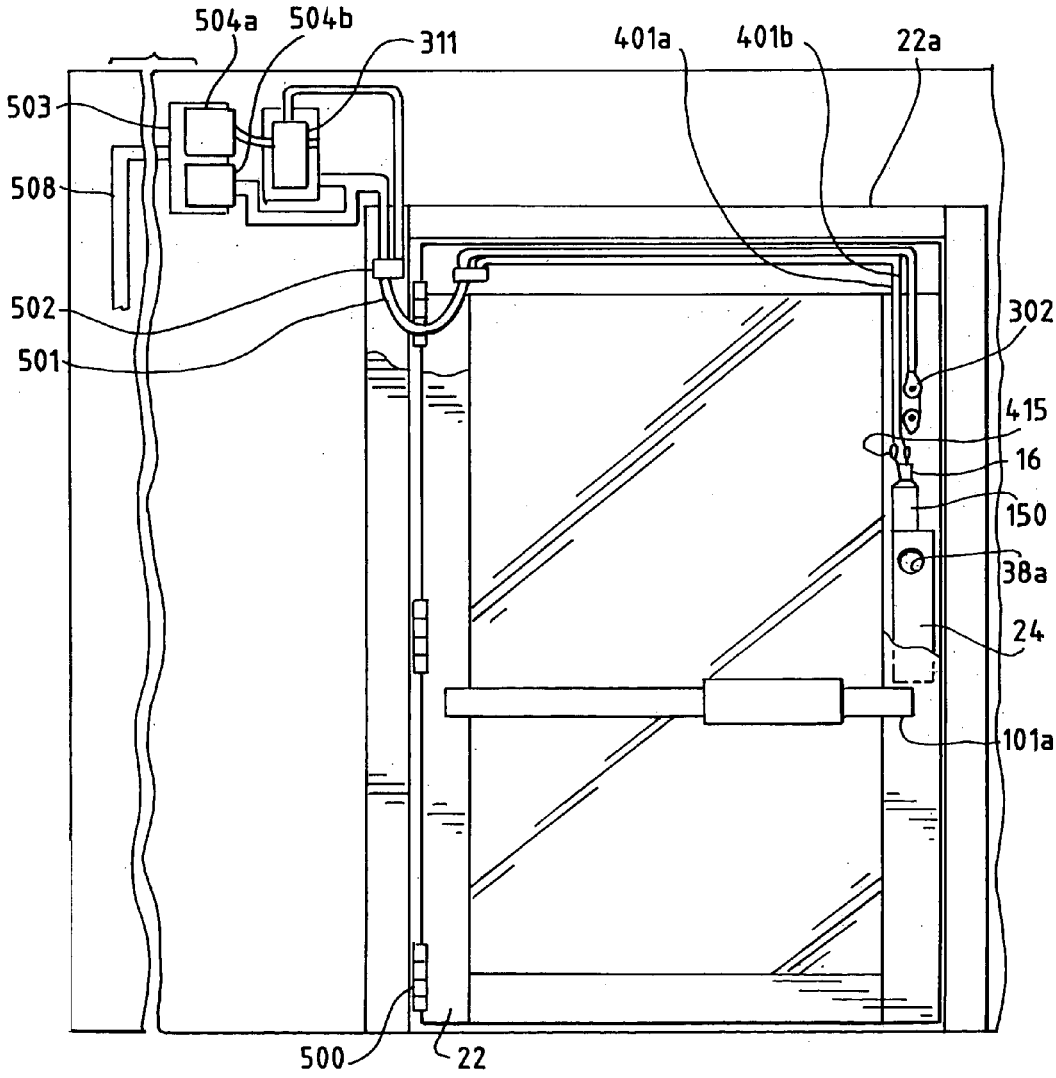
FIG. 10 illustrates a schematic view of the exterior doorframe with the electromagnetic components operatively connected.

Referring now to FIG. 10, first solenoid end wire 142*a* leads to solenoid 1*a* from door controller 311. From solenoid 1*a*, second solenoid end wire 142*b* returns to the positive terminal of transformer 504*a* and then to door controller 311 to complete the circuit. The proximity access code reader 302 in the preferred embodiment can be obtained from:

Keri Systems, Incorporated

1530 Old Oakland Road

Suite 100

San Jose, Calif. 95112

Phone: 1-800-260-5265

Model #: IP 3000 Microstar Proximity Reader

Door controller 311 allows access by switching the appropriate electrical relays to send low voltage current to solenoid 1*a*. This low voltage to solenoid 1*a* results in a magnetic force field, which elevates cam retaining locking bar 118*b* with attached hollow stem 118*a* away from rotating cam 56. The user can mount proximity code access reader 302 within hollow metal doorframe casing 22(preferred), an adjacent hollow metal doorframe casing, or an edge doorframe casing.

When the appropriate voltage (12 VAC, 16 VAC, 24 VAC, or 12 VDC, 16 VDC, 24 VDC) (where VAC indicates voltage, alternating current, and VDC indicates voltage, direct current)is applied to solenoid 1*a*, a magnetic field is created. However, the preferred solenoid voltage in my invention is approximately 16 VAC. After the appropriate time interval dictated by proximity access code reader 302, the voltage to solenoid 1*a* is discontinued. A subsequent magnetic force field of solenoid 1*a* then initiates another door access cycle by elevating hollow stem 118*a* into solenoid cavity 1*c*, until the voltage is again discontinued.

Installation Process

Prior to installation of my modified lock, the operator must determine what is known as the back set of the predetermined doorframe casing 22 with which he is working. Each hollow metal doorframe casing 22 comprises one of the following back sets: 31/32 inch; 7/8 inch; and 1 and 1/2 inch.

In this context, a 'back set' refers to the distance from edge 30*aa* or 30*bb* of lateral longitudinal plate 30 to the center of cylinder lock 66 when inserted through anterior plate 24. Each hollow metal doorframe casing 22 is precut for one particular back set. As a result, each back set distance is different, thus predetermining the exact dimensions of cam retaining locking bar 118*b*. Hollow metal doorframe casing 22 is also pre-cut with two one and 1/4 inch apertures 38*a*, 38*b*. Cylinder lock 66 and thumb turn 43 insert into these apertures respectively, after reinstallation of deadbolt 10, infra.

Proper identification of the existing lock type is also important for a proper fit within anterior, posterior and lateral longitudinal plates 24, 26, 30 respectively. In addition, the operator determines door orientation, i.e., left handed or right handed. Determination of the left or right handed orientation of hollow metal doorframe casing 22 assures that the appropriate cylinder lock 66 for only an authorized key 152 has first rotating cam 56 attached to extended shaft 35.

Figure 10A:
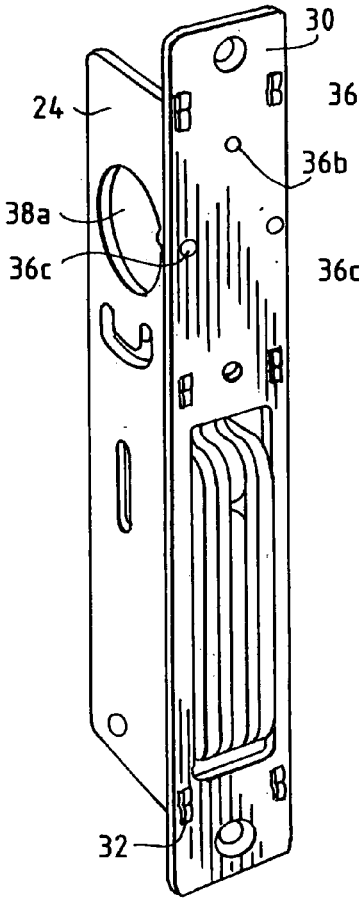
FIG. 10*a* is a partial anterior view of an anterior plate in a right handed orientation.
Figure 10B:
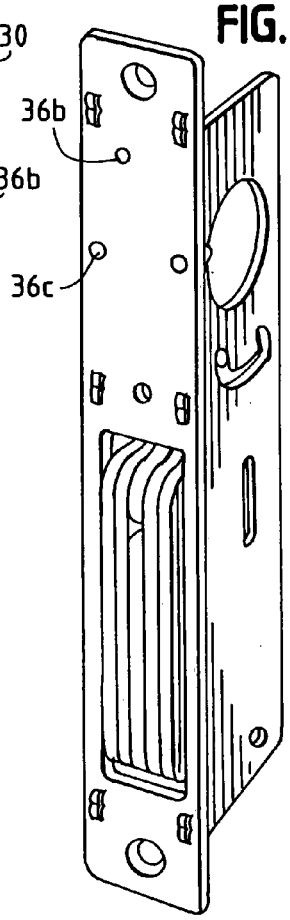
FIG. 10*b* is a partial perspective isolated view of the anterior plate in a left-handed orientation.

A right handed doorframe will have the lock on the right side of the door, when the operator is facing the doorframe casing's exterior surface. As seen in FIGS. 10*a* and 10*b*, in a left handed door swing, there is approximately 1/8 inch offset towards large circular aperture 38*a* to the left.

In a right handed door swing, there is approximately 1/8 inch offset to the right towards large exterior circular aperture 38*a*. Similarly, a left-handed doorframe casing has the keyed lock on the left side of the exterior surface of the door, and the hinges on the right edge of the doorframe casing. Thumb turn 43 is unrestricted because there are no conventional key access pins or electronic access features. This lack of pins and electronic access is a requirement for fire and other safety ordinances in building codes.

Whether a door is right handed or left handed is an initial determination well known to those in this particular industry. The modification of the width of cam retaining locking bar 118*b* (as well as that of solenoid 1*a*) does not affect the installation of my electromagnetic locking device with the following back sets: 31/32 inch; 7/8 inch; one and 1/8 inch; and one and 1/6 inch. Presently, a 1 and 1/8 inch back set is the most marketed measurement in this particular industry.

Opposite edge 118*d* of cam retaining locking bar 118*b* is precut or custom adjusted for each individual hollow doorframe casing's particular back set. The increased length of opposite edge 118*d* allows cam retaining locking bar 118*b* to fit within lateral longitudinal plate 30 and posterior solenoid housing opposing wall 150*c*.

These two rigid vertical surfaces physically restrict cam retaining locking bar 118*b* from lateral movement. Lateral longitudinal plate 30 and opposing wall 150*c* also discourages attempts to force or jam cam retaining locking bar 118*b*. As seen in FIG. 10, door lock components are positioned above a typical prior art door handle 101*a*.

In the best mode and preferred embodiment of my invention, the installation of solenoid 1*a*, solenoid casing 1*b*, solenoid housing 1*c*, and cam retaining locking bar 118*b* is as follows:

Removal of Deadbolt

The operator first loosens three trim plate screws (not seen) from the attached trim plate(not seen) in the preferred embodiment. He then loosens set screws 36*c* which retain cylinder lock 66(and/or thumb turn 43) within plates 24 or 26. He continues to loosen set screws 36*c* until cylinder lock 66 and thumb turn 43 are sufficiently loose to unthread and remove.

Figure 11:
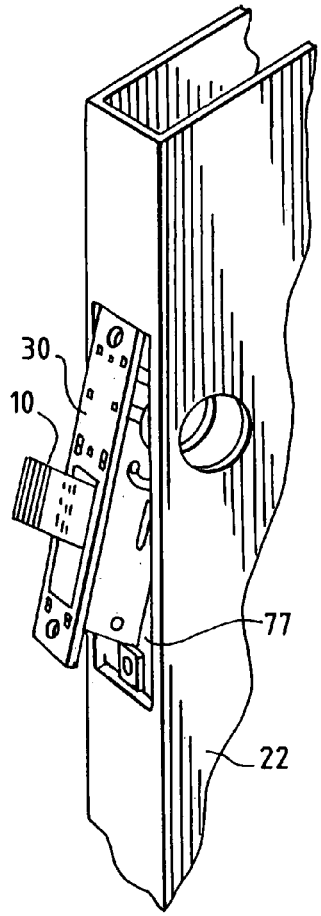
FIG. 11 illustrates how mechanical lock components are initially removed from a hollow metal doorframe casing.

After cylinder lock 66 and thumbscrew 43 are removed, the operator removes top screw 36*e* and bottom screw 36*f* which attach deadbolt within hollow metal doorframe casing 22. After removal from doorframe casing 22(FIG. 11), deadbolt 10, along with other mechanical components between attached plates 24,26,30, are placed in an upright position within a vise.

The vise clamps lateral longitudinal plate 30, as well as anterior plate 24 and posterior plate 26. If the hollow metal doorframe casing 22 has no pre-welded mounting tabs 430*a*, 430*b* (FIG. 2*c*) attachable mounting tabs for glass/aluminum doors are available as:

Adams Rite® Mounting Bridge

Model No. 4104-01, -02, -03, -04 and Afco No. AF11.

In these instances, the operator uses shorter screws to fasten tabs 430,430*a*, so that the shorter screws 36*a* do not interfere with electronics and metal solenoid housing 150.

Wiring and Installation of Electronic Related Components

Deadbolt 10, rocking lever 14 and other mechanical components are now removed from and exterior to metal hollow doorframe casing 22. However, they remain within attached anterior plate 24, posterior late 26 and lateral longitudinal plate 30 and within vise 77.

The operator now turns his attention to wiring of metal hollow doorframe casing 22 and placement of electronic equipment, such as the access code proximity reader 302 and door controller Access code proximity reader 302(Keri Smart module SM 1000/2000) is preferably contained within an electronic utility box 503. Electrical utility box 503 is approximately seven inches in length, eight inches in width and four inches in depth.

As seen in FIG. 10, electric utility box 503 is preferably mounted within an inner wall surface, above a drop ceiling and near the door area. If there is no drop ceiling, then a secured room or a nearby closet are satisfactory alternatives. A pair of long 22 gauge connecting wires 401*a*,401*b* from electronic utility box 503 pass through door cord 501 and then pass across upper doorframe casing surface 22*a*. Door cords 501 for the preferred embodiment are available from:

Keedex Inc.

Armoured Door Loops

112931 Shackelford Lane

Garden Grove, Ca. 92841-5108

Phone: 1-714-636-5657

Model K-DL38A24 (aluminum)

Model K-DL38B224 (durandic)

Figure 14A:
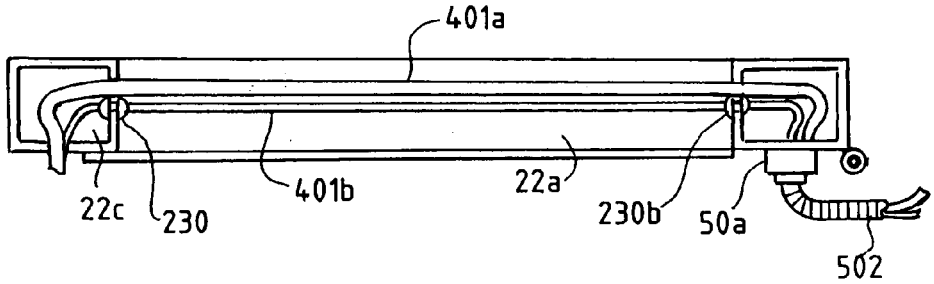
FIG. 14*a* is a top plan schematic representation of how wires pass over and then enter hollow metal doorframe casing.

Using a Dremel® wheel (model number 395,426) the operator next excises a first 'v'-cut 230*a* and second v-cut 230*b* through uppermost door casing surface 22*a*, as seen in FIG. 14*a*. The operator inserts each long connecting 22 gauge wires 401*a*, 401*b* respectively through first v-cut 230*a* and second v-cut 230*b* respectively. First and second long 22 gauge connecting wires 401*a*,401*b* respectively enter hollow interior 22*c* of hollow metal doorframe casing 22. Duct tape is recommended to assist in pulling wires 401*a*, 401*b* through hollow metal doorframe casing interior 22*d*.

The length of each first and second long connecting 22 gauge wires 401*a*, 401*b* should be a minimum of approximately seven feet, to allow sufficient wire length to thread through the door frame interior. The operator can determine the approximately additional length of wires 401*a* and 401*b* by measuring the distance between door cord 501 location to the location of transformer 504*a*, 504*b*.

First and second solenoid wire ends 142*a*, 142*b* respectively should each be approximately six to ten inches in length. These two lengths are the minimum necessary to(i) physically and electrically connect solenoid 1*a* wire end segments 142*a*, 142*b* to gauge long connecting wires 401*a* and 401*b*, while (ii) deadbolt within attached plates 24, 26, 30 remains exterior to doorframe casing 22.

Long connecting 22 gauge wires 401*a*, 401*b* pass through door cord 501 and electrically connect to transformer 504*b* in a manner well known in this particular industry. Please see FIGS. 10, 14*a* and 14*b*. Referring again to FIG. 10, the operator next attaches the preferred B or Beanie connectors 415, with black electric tape placed over B connectors 415. B or Beanie connectors 415 crimp first and second solenoid wire ends 142*a*, 142*b* respectively to each first and second ends 401*c*, 401*d* respectively, of long connecting 22 gauge wires 401*a*, 401*b* respectively.

The wiring process, installation, and electrical connection of transformers 504*a*, 504*b*, access code proximity reader 302, and door controller 311 to solenoid 1*a*, is completed in a manner well known in this particular industry. In sum, long connecting 22 gauge wires 401*a*, 401*b*, as well as proximity reader 302 six (6) conductor shielded wire 404*a*, run from door controller 311 through the walls to and through door cord 501. All three wires 401*a*, 401*b*, 404*a* pass through door cord 501 over upper hollow metal doorframe casing surface 22*a*.

Figure 14B:
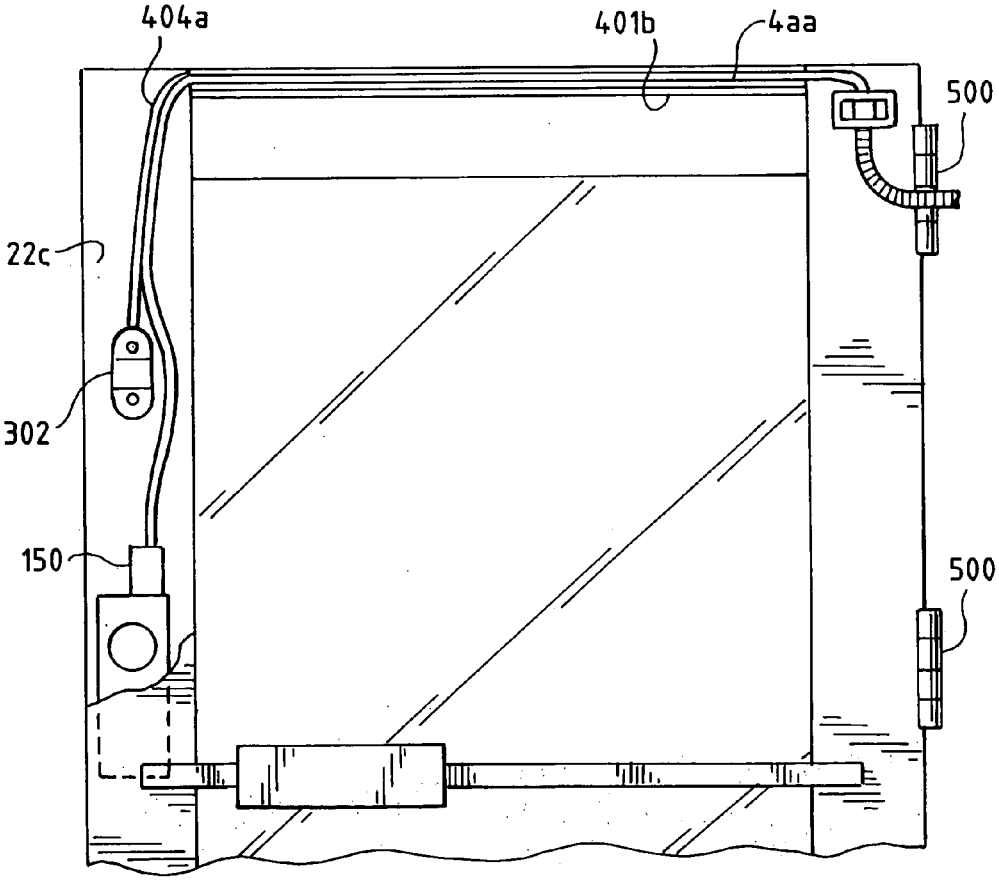
FIG. 14*b* is an anterior view of the interior hollow metal doorframe casing illustrating exposed wiring and electronic components.
Figure 15:
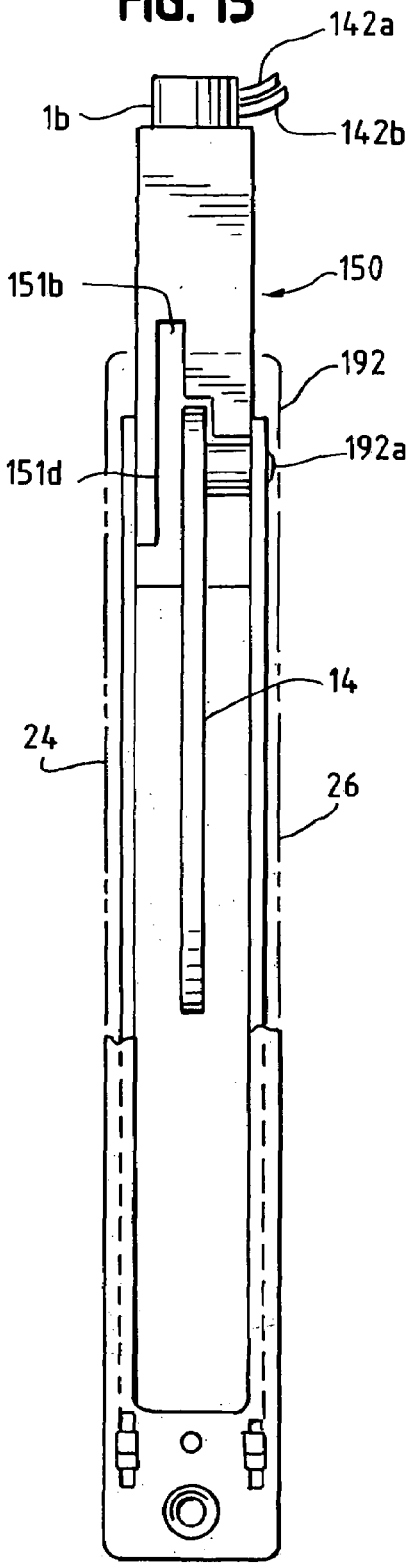
FIG. 15 illustrates the alignment of metal solenoid housing during the installation process.

Wire 404*a* electrically and physically connects to proximity reader 311 (not shown in FIG. 14*b*). All three wires 401*a*, 401*b*, 404*a* then enter hollow interior of hollow metal doorframe casing through v-cuts 230*a*, 230*b*, in a contiguous manner well known in this particular industry.

Insertion of Solenoid 1*a* and Other Components Into Hollow Metal Doorframe Casing 22

Figure 12:
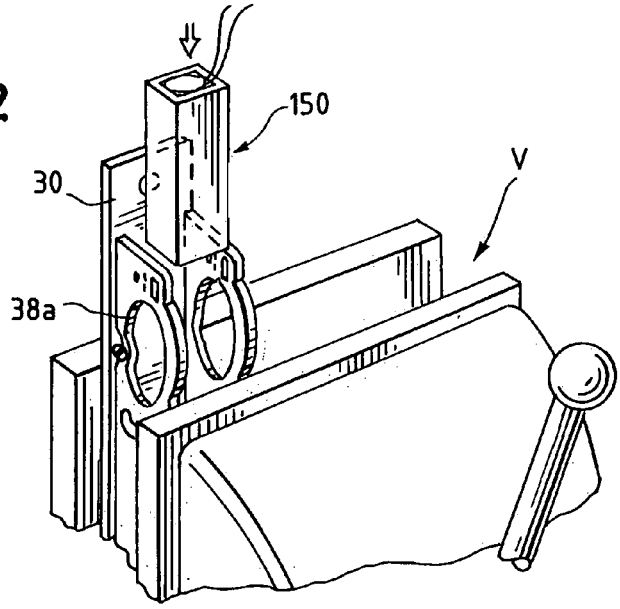
FIG. 12 illustrates how the attached plates are oriented within a vise after removal from a hollow metal doorframe casing.

Solenoid 1*a*, although now electrically connected through doorframe casing 22 by aperture 77, remains exterior to hollow metal doorframe casing 22 at this point in the installation process. Anterior plate 24, posterior plate 26 and lateral longitudinal plate 30 remain attached to each other, and within a vise as shown in FIG. 12.

Turning now to the subassembly of the new components, in some embodiments the operator inserts solenoid 1*a* into cylindrical solenoid casing 1*b*. In the preferred embodiment, as described supra, solenoid 1*a* comes pre-sealed on a hollow spool 1*e* within solenoid cylindrical casing 1*b*.

The operator next takes cam retaining locking bar 118*b* and attaches it to metal hollow stem 118*a* by insertion of small knob 118*a* into ovoid slot 118*g*. The operator also inserts small spring 123 into metal hollow stem 118*a*. The operator slides assembled cam locking retaining bar 118*b* and hollow stem 118*a*, into cylindrical casing cavity 1*c*. The operator aligns cam-retaining locking bar 118*b* and cylindrical solenoid casing 1*b* within a predetermined metal solenoid housing 150.

The operator now inserts a Dremel® wheel through large circular aperture 38*a*. He severs sleeve 192 and large pin 192*a* immediately adjacent to rocking lever 14, and on the surface 14*e*, 14*f* which will abut cam retaining locking bar 118*b*. Whether the operator severs on first longitudinal surface lever 14*e* or second longitudinal lever surface 14*f* depends upon whether hollow metal doorframe casing 22 is right-handed or left-handed. As noted supra, this is predetermined in a manner well known in this particular industry. Please see FIG. 12.

Alternatively and in other modes, the operator can obtain precut mechanical lock components which are pre-cut for a right handed or left-handed installation. Generally, first longitudinal lever surface 14*e* requires large sleeve 192 and large pin 192*a* severed for a right-handed installation. Second longitudinal lever surface 14*f* requires sleeve 192 and pin 192*a* to be severed for a left handed doorframe installation.

Using a hand drill or drill press with a ¼ inch drill bit, the operator now removes that portion of large pin 192*a* which remains attached to anterior plate 24. The operator also sands first longitudinal lever surface 14*e* or second longitudinal lever surface 14*f* until either surface is smooth and flat (depending again upon whether the handle assembly is right handed or left handed).

The distance between anterior plate interior surface 24*b* and posterior plate interior surface 26*b* is slightly more than ⅝ of an inch. Similarly, the width and depth of metal solenoid housing 150 are both slightly less than ⅝ inch. This means that after large sleeve 192 and large pin 192*a* are removed, the operator can push metal solenoid housing downward so that mechanical fasteners attach metal solenoid housing 150 to anterior and posterior plates 24,26 respectively.

After large sleeve 192 and large pin 192 are severed and removed, the operator manually positions metal solenoid housing 150 vertically downward between anterior late 24 and posterior plate 26. At this point, metal solenoid housing 150 is adjusted to its final position. Small rivet tapped apertures of approximately ⅛ inch diameter 163*a*, 163*b*, 164*a*, 164*b* are drilled through metal solenoid housing walls 150*a*, 150*b*, 150*c*, 150*d*. Rivets 167 which are approximately ⅛ thick by ¼ inch long, or other similar small mechanical fasteners are fastened and secured into apertures 163*a*, 163*b*, 164*a*, 164*b*, and mechanically attach metal solenoid housing 150 to anterior plate 24.

The operator now cuts cam retaining locking bar 118 to fit for either a right handed or left handed installation within the preferred back set of 1 and ⅛ inch. After this adjustment, cam retaining locking bar 118*b* now fits into space created by cutting and sanding away large pin 192*a* and large sleeve 192. The preferred appropriate Dremel® wheel for adjusting the length of cam retaining locking bar 118*b* is model number #3950. This Dremel® wheel is available from:

Dremel® Accessories

P.O. Box 081126

Racine, Wis. 53408-1126

Phone: 414-554-1390

After metal solenoid housing 150 is positioned between anterior plate 24 and posterior plate 26, the operator adjusts solenoid housing's lower edge 151*e*. Such adjustment is made with a hand held frictional wheel, drill, shears, or other appropriate tool well known in the locksmithing industry. As seen in FIG. 10*b*, temporary assisting screw 36*b* supports cam retaining locking bar 118*b* during installation.

This same temporary assisting screw 36*b* is then loosened until cam retaining locking bar 118*b* drops over rotating cam 56. The operator removes temporary assisting screw 36*b* immediately thereafter. Cylinder lock 66 is then threaded into large circular aperture 38*a* for testing the operation of the newly installed components.

This is the last step occurring within the vise, and prior to checking function and connecting wire segments 142*a* and 142*b* to long connecting 22 gauge wires 401*a* and 401*b*. In this manner, lower edge 151*e* sufficiently clears rocking lever 14 when solenoid housing 150 is properly aligned within anterior plate 24, lateral longitudinal plate 30 and posterior plate 26. Metal solenoid housing 150 must also allow rocking lever 14 to pivot when deadbolt 10 rotates from a default locked position to an open unlocked position.

The operator now inserts cylindrical solenoid casing 1*b* into metal solenoid housing 150. Casing 1*b* extends as far downward as possible without jamming cam retaining locking bar 118*b*. The operator drills approximately 7/64 inch diameter apertures 36 into metal solenoid housing 150. Please see FIG. 5*a*. These apertures are best drilled with a "pling" style tap and inserted with set screws 36*c*.

Set screws 36*c* retain and stabilize solenoid 1*a* within metal solenoid housing 150 until solenoid 1*a* requires replacement. Metal solenoid housing 150, cylindrical solenoid casing 1*b*, solenoid 1*a*, and cam retaining locking bar 118*b* with attached hollow stem 118*a* are now assembled above rocking lever 14. Deadbolt 10 remains attached to and interior to plates 24, 26, 30, while the entire assembly remains exterior to metal hollow doorframe casing 22.

Referring now to FIGS. 13*a* and 13*b*, the next step is the physical installation of the mechanical and electronic lock components within attached plates 24, 26, 30 into hollow metal doorframe casing 22. The operator tips attached anterior, posterior and lateral longitudinal plates 24, 26, 30 respectively through large rectangular aperture 77 past mounting tabs 420*a*, 420*b*. He finally and reinserts them upwardly into hollow metal doorframe casing 22.

Plates 24,26,30 are now upright and flush within hollow metal doorframe casing 22. Lateral longitudinal plate 30 is also properly aligned with upper tab aperture 430*a*. The operator places small screws 36*a* (approximately 10/32 inch diameter×⅜ inch long)through top aperture 30*a* and bottom aperture 30*b*, and into hollow metal doorframe casing 22. He then he tightens deadbolt 10 into hollow metal doorframe casing 22.

The operator next reinserts cylinder lock 66 into aperture 38*a* and thumb turn 43 into circular aperture 38*b*, and then tightens set screws 36*c*. He next checks for proper rotation of extendible shaft 35 by locking and unlocking now reinstalled deadbolt 10 with key 152. After lock cylinder 66 and thumb turn are re-installed, the operator loosens temporary assisting screw 36*b*, allowing cam retaining locking bar 118*a* to grip rotating cam 56.

Alternatively, an operator skilled in the art of locksmithing can partially prepare a hollow metal doorframe casing with components of a kit. In the best mode and preferred embodiment, each kit contains the following: pre-assembled solenoid 1*a* within cylindrical casing from Adams-Rite, solenoid housing 150, hollow member 118*a*, small spring 123 and cam retaining locking bar 118*b*. Electronic reader and processors 302,307 as well as electronic key cards 301 and related equipment could also be included within each kit and remain within the scope of my invention.

In the preferred embodiment and best mode, each kit is intended for one doorframe per service call per operator. However, kits with varying numbers of installation components, or kinds of components are also within the scope of my invention. For example, some kits would only include a cam retaining locking bar 118*b*, hollow stem 118*a*, third spring 123, pre-assembled solenoid 1*a* from Adams-Rite® and solenoid housing 150.

If a kit comprises the pre-assembled solenoid 1*a*, metal solenoid housing 150, hollow stem 118*a*, third spring 123, and cam retaining locking bar 118*b*, a person skilled in this particular art would require approximately one hour to install these new components as a retrofit. In this context, "retrofit" indicate the operator's use of Adams-Rite® dead bolts 10 or hook bolts 10*a*.

These particular dead bolts and hook bolts immediately supra are compatible with Adams-Rite® glass/aluminum hollow doorframe casings 22, and are easily replaced by the operator's inventory in an emergency. The one-hour time frame, supra, includes the reinstallation of mechanical components rocking lever 14, deadbolt 10*a*, extension pins 202*a*, 204*a*, first and second opposing roller cams 202, 204 and rotating sleeve 210, and first and second springs 18*a*, 18*b*.

This same time frame also includes insertion and attachment of cylindrical solenoid casing 1*b* within metal solenoid housing 150, cam retaining locking bar 1*b*, hollow stem 118*a* and their proper alignment; reinstallation of lateral longitudinal plate 30, anterior plate 24, posterior plate 26, and removal of large pin 192*a* and sleeve 192.

An additional time of approximately two to three hours is necessary required to connect my integrated lock to Keri smart module 145(model IP 1000/2000) and proximity access code reader Cam retaining locking bar 118*b* is the least vulnerable point for physical damage, because cam retaining locking bar 118*a* physically blocks attempts to wrench lock cylinder 66 during unauthorized entry attempts.

In addition, with my invention there is no irreparable cutting or physical alteration hollow metal door frame casing 22. Instead installation of cam retaining locking bar 118*a* and solenoid 1*a* preserves the physical integrity of the previously installed doorframe.

My cam retaining locking bar 118*b* greatly maximizes circumvention of cylindrical lock 66, because it physically blocks intentional rotational motion even if cylinder lock 66 is destroyed. My cam retaining locking bar 118*b* also preserves the physical integrity of extending shaft 35. This damage occurs when the unauthorized third party uses a conventional screw driver to rotate extending shaft 35 through key aperture 35*c*.

The retention of cylinder cam locking bar 118 fitting tightly around cylindrical lock shaft cam member 35*a* immediately slows and frustrates manual attempts to physically wrench the mechanical lock. Mechanical locks of the future can be upgraded for extra security with my new electromagnetic integrative security devices.

The electronic override feature of my upgraded locking device from the access side of the door, does not affect the ability to immediately open the same hollow metal doorframe casing from its opposite side which faces the interior of the secured space, container or room. The opening of such a door frame casing by conventional devices as a thumb turn, is required by fire ordinances, supra. The thumb turn is completely removed from the electronic circuit required to override access, as opposed to egress.

The description of my preferred embodiment in no way diminishes the scope or embodiments of my invention.

I claim:

1. A locking device, said locking device combining mechanical and electromagnetic access security components within a securing structure, said locking device comprising:

(a) an electromagnetic field generating device, said electromagnetic field generating device being the sole source of electromagnetic force within said locking device, said electromagnetic field generating device comprising:

(1) a single solenoid, and (2) a single metal solenoid housing, said metal solenoid housing comprising a separate physical article from said solenoid and said mechanical lock components, (3) a single cylindrical solenoid casing, said cylindrical solenoid casing comprising a separate physical article from said single metal solenoid housing and said mechanical lock components, said cylindrical solenoid casing comprising a separate physical article from said solenoid, said cylindrical solenoid casing enclosing said solenoid, said metal solenoid housing enclosing said cylindrical solenoid casing, (b) a single electronically controlled obstructing component with an attached hollow stem, said electronically controlled obstructing component physically obstructing a single mechanical component when said electronically controlled obstructing component falls from a zero magnetic field created by said solenoid, (c) A single pivoting deadbolt or hookbolt, said pivoting deadbolt or hookbolt rotating to a retracted position, said deadbolt lacking electromagnetic components, said pivoting deadbolt or hookbolt cooperating with said remaining mechanical components, said deadbolt or hookbolt positioned exterior to said electromagnetic field generating device, said single electronically controlled obstructing component being the sole component within said locking device which electromagnetically initiates retraction of said pivoting deadbolt or said hookbolt.

2. A locking device in combination with a hollow metal doorframe casing comprising a door, said locking device comprising mechanical lock components, said mechanical lock components comprising three attached plates and a rocking lever, said locking device further comprising:

(a) an electromagnetic field generating device, said electromagnetic field generating device consisting of a sole and only solenoid positioned within said hollow metal doorframe casing, said locking device consisting of said sole and only solenoid and no other solenoids, said locking device lacking additional electromagnetic field generating devices, (b) a sole and only cylindrical metal solenoid casing, said sole and only cylindrical metal solenoid casing comprising a circular top metal surface, said attached plates enclosing said sole and only cylindrical metal solenoid casing, a sole and only metal solenoid housing enclosing said sole and only metal cylindrical solenoid casing, said sole and only metal cylindrical solenoid casing enclosing said sole and only solenoid, (c) an electrical connection between said sole and only solenoid, a transformer and a proximity code reader, said electrical connection overriding said mechanical components, said electrical connection of said sole and only solenoid creating a magnetic field, and (d) a pivoting deadbolt or hookbolt, said sole and only solenoid initiating retraction of said pivoting deadbolt or hookbolt, said sole and only solenoid being structurally separated by said mechanical lock components from said pivoting deadbolt or said pivoting hookbolt, said locking device further consisting of a single cam, said locking device consisting of:

a single cam retaining locking bar with a single hollow stem, said cam retaining locking bar adapted to block rotation of said single cam, and a single third spring, said single third spring lodging within said single hollow stem, said single third spring exerting force against said circular top metal surface within a magnetic force field, said single third spring not being an integral component of said hollow stem, said single cam retaining locking bar physically obstructing said cam whenever said sole and only solenoid generates a zero magnetic force field.

3. A locking device comprised of mechanical components and electrical lock components within a hollow metal doorframe casing, said locking device comprising:

(a) three attached plates, said attached plates comprising an anterior plate, a posterior plate and a lateral longitudinal plate, said anterior plate and said posterior plate each attached to said longitudinal plate, said anterior plate, said posterior plate and said lateral longitudinal plate thereby forming a three-sided enclosure within said hollow metal doorframe casing, said anterior plate and said posterior plate each comprising one upwardly extending curved aperture, (b) a deadbolt or hookbolt positioned between said anterior plate, posterior plate and lateral longitudinal plate, said deadbolt or hookbolt connected by mechanical fasteners to said anterior plate and said posterior plate, said deadbolt or hookbolt comprising a deadbolt pivot pin, (c) a rocking lever, said rocking lever comprising a lever pivot pin, said rocking lever mechanically connected to said deadbolt by said lever pivot pin, (d) a single sleeve comprising a first sleeve end and a second sleeve end, said each said sleeve end terminating within said corresponding curved grooved aperture within said first anterior plate or said posterior plate, said sleeve further mechanically cooperating with (1) a first opposing roller cam; and (2) a second opposing roller cam, said first and second opposing roller cams rotating upon said sleeve, (e) a cylindrical solenoid casing, (f) a metal solenoid housing, said metal solenoid housing comprising a separate structure from said cylindrical solenoid casing, said metal solenoid housing comprising:

(1) a removable plastic cap, said removable plastic cap fitting tightly over said solenoid housing's upper edge, (2) set screw apertures, said set screw apertures positioned to receive set screws for stabilization of said cylindrical solenoid casing within said metal solenoid housing, (3) an upper edge and a lower edge, and (4) a slot for wires, said cylindrical solenoid casing lodged within said metal solenoid housing, (G) a rotating cam, said rotating cam attached to a keyed extended shaft, said extended shaft rotated by a properly shaped key, said rotating cam rotating when said extended shaft is rotated by said key, (h) a solenoid, said solenoid enclosed within said cylindrical solenoid casing, said solenoid comprising a hollow solenoid cavity, (i) a cam retaining locking bar, said cam retaining locking bar reversibly attached to a hollow stem at a right angle, said hollow stem containing a third small spring, said hollow stem positioned so said hollow stem protrudes towards said hollow solenoid cavity, whereby, said solenoid generates a magnetic field, causing said cam retaining locking bar to move vertically upward within said hollow solenoid cavity, whereupon said rotating cam disengages from said cam retaining locking bar, said rotating cam exerting force upon a single said opposing roller cam, said force causing both said opposing roller cams and said sleeve to move downward through said rocking lever, said sleeve ends moving within said curved apertures as said sleeve moves downward through said rocking lever, said lever pivot pin moving downward within said deadbolt or hookbolt, thereby causing said deadbolt or said hookbolt to rotate around said deadbolt pivot pin and retract, said sleeved ends within said curved apertures maintaining said deadbolt or hookbolt in its retracted position.

4. A locking device, said locking device combining electronic access security components within a securing structure, said locking device comprising:

(a) mechanical components, said mechanical components originally installed within said securing structure, said mechanical components remaining assembled within attached plates when removed from, and re-installed within said securing structure, said securing structure remaining unmodified during said removal and said reinstallation, (b) an electromagnetic field generating device, (c) a metal solenoid housing, said metal solenoid housing comprising a polyhedron, said metal solenoid housing comprising a separate physical entity from said electromagnetic field generating device, said metal solenoid housing comprising an upper open end and a lower open end, said solenoid housing comprising a notched lower edge, said notched lower edge inserting above said rocking lever and between said attached plates while said rocking lever, said attached plates and said magnetic filed generating device are positioned exterior to said hollow metal door frame casing, (d) a cylindrical solenoid casing, said cylindrical solenoid casing comprising a separate physical article from said metal solenoid housing and said magnetic field generating device, said cylindrical solenoid casing enclosing said magnetic field generating device, (e) an electronically controlled obstructing component with an attached hollow stem, a third small spring being inserted within said attached stem, said electronically controlled obstructing component physically obstructing a mechanical component when said electronically controlled obstructing component moves away from a magnetic field created by said magnetic field generating device, said electronically controlled obstructing component physically obstructing a protruding member upon a rotating cam, said electronically controlled obstructing component standing free from physical attachment to said mechanical and electronic components, (f) an electrical connection between said magnetic field generating device, a transformer and a proximity code reader, said electrical connection overriding said mechanical components by activating a physically obstructing electronically controlled lock component, said overriding electrical connection not overriding mechanical access by a second separate mechanical device for automatic egress, whereby said electrical connection to said magnetic field generating device creates a magnetic field, and said attached plates contain said assembled mechanical and electronic components, said mechanical locking components remaining assembled within said attached plates during removal or re-installation into said hollow metal doorframe casing.

5. A locking device comprising electronically upgraded mechanical lock components within a hollow metal doorframe casing of a door as described in claim 4, wherein (a) said hollow stem is perpendicular to said cam retaining locking bar, and (b) said cylindrical solenoid casing is cylindrically shaped with a circular top metal surface.

6. The locking device for electronically upgraded conventional mechanical lock components as described in claim 5, wherein said solenoid is a pre-assembled upon a cylindrical spool, said solenoid consisting of copper wire.

7. The locking device for upgraded mechanical components within a hollow metal doorframe casing of a door as described in claim 6, wherein (a) said solenoid housing comprises aluminum, and said solenoid housing lower edge is shaped so said protruding member rotates freely and said cam retaining locking bar can easily disengage from said cam protuberance, (b) said solenoid housing lower edge further pre-cut so said solenoid housing can easily insert above said rocking lever.

8. The locking device for upgraded mechanical components with integrated electronic access components as described in claim 7, wherein said third small spring contacts and pushes against said cylindrical solenoid casing, thereby preventing permanent magnetization of said hollow stem.

9. The locking device for upgraded mechanical components with electronic access components as described in claim 8, wherein said cam retaining locking bar comprises a thin steel sheet with chrome plating, said cam retaining locking bar comprising at least approximately 10% zinc and approximately 50% steel.

10. The upgraded locking device with integrating electronic components as described in claim 9, said cylindrical solenoid casing comprising a single pinhole aperture.

11. The upgraded locking device with integrating electronic components as described in claim 10, wherein said solenoid comprises two solenoid end wires, said two solenoid end wires traversing said cylindrical solenoid casing through said single pinhole aperture.

12. The upgraded locking device with integrated electronic components as described in claim 11, wherein a hook bolt is substituted for said deadbolt.

13. A locking device with electronically upgraded mechanical components for a hollow metal door frame casing comprising a door as described in claim 12, wherein (a) said hollow metal doorframe casing requires no modification after re-installation of said upgraded locking device, (b) said attached plates are shaped and of appropriate dimensions to be removed from or, reinserted through, a large rectangular aperture past mounting tabs along said metal hollow doorframe casing.

14. The locking device with electronically upgraded mechanical components for a hollow metal door frame casing comprising a door as described in claim 13 wherein said electronic components comprise:

(a) a transformer and a proximity reader, said transformer and proximity reader being in physical proximity to said hollow door frame casing, (b) said electronic devices electrically connected to generate an access-based cyclical magnetic field within said solenoid.

15. The locking device with electronically upgraded mechanical components for a hollow metal doorframe casing comprising a door as described in claim 14 wherein (a) said cam retaining locking bar is approximately one and one-quarter inches in width and three-quarters inch in length, (b) said hollow stem is approximately one and one-quarter inch in length; and (c) said solenoid cylindrical casing is approximately one and three-quarters inches in length and one-half inch in diameter.

16. The locking device with electronically upgraded mechanical components for a hollow metal door frame casing comprising a door as described in claim 15 wherein said metal solenoid housing comprises a hollow approximately rectangular polyhedron consisting of two first opposing parallel sides and two second opposing parallel sides, said metal solenoid housing attaching to said anterior plate by two small rives, said metal solenoid housing attaching to said posterior plate by two small rivets, said metal solenoid housing lacking a base or ceiling.

17. The locking device with electronically upgraded mechanical components for a hollow metal door frame casing comprising a door as described in claim 16 wherein said metal solenoid housing comprises:

(a) sectioned aluminum square tubing, (1) said aluminum square tubing being approximately five-eighths inch in diameter, (2) said aluminum square tubing consisting of metal alloy number 6063-T-52, (3) said aluminum square tubing sectioned by a rotary wheel, (b) said hollow stem comprising stainless steel, (c) said cam retaining locking bar comprising a small arm and a small ovoid slot which grips said hollow stem, said hollow stem further comprising a knob which fits within said arm and said ovoid slot.

* * * * *